US005370983A

United States Patent [19]

Shono et al.

[11] Patent Number: 5,370,983

[45] Date of Patent: * Dec. 6, 1994

[54] SILVER HALIDE PHOTOGRAPHIC MATERIAL COMPRISING AN OIL-IN-WATER TYPE DISPERSION

[75] Inventors: Akiko Shono; Osamu Takahashi, both of Kanagawa, Japan

[73] Assignee: Fuji Photo Film Co., Ltd., Kanagawa, Japan

[ * ] Notice: The portion of the term of this patent subsequent to Jun. 25, 2008 has been disclaimed.

[21] Appl. No.: 54,610

[22] Filed: Apr. 30, 1993

Related U.S. Application Data

[63] Continuation of Ser. No. 643,610, Jan. 22, 1991, abandoned.

[30] Foreign Application Priority Data

Jan. 22, 1990 [JP] Japan ..... 2-012331

[51] Int. Cl.[5] ..... G03C 7/388; G03C 7/396

[52] U.S. Cl. ..... 430/546; 430/627; 430/631; 430/634; 430/635

[58] Field of Search ..... 430/546, 627, 631, 634, 430/635

[56] References Cited

U.S. PATENT DOCUMENTS

| | | | |
|---|---|---|---|
| 4,419,441 | 12/1983 | Nittel et al. | 430/546 |
| 5,006,453 | 4/1991 | Takahashi et al. | 430/546 |
| 5,019,490 | 5/1991 | Kobayashi et al. | 430/503 |
| 5,026,631 | 6/1991 | Yoneyama | 430/546 |
| 5,071,738 | 12/1991 | Mizukura et al. | 430/546 |
| 5,077,188 | 12/1991 | Tanji et al. | 430/546 |

*Primary Examiner*—Lee C. Wright

*Attorney, Agent, or Firm*—Sughrue, Mion, Zinn, Macpeak & Seas

[57] ABSTRACT

A silver halide photographic material containing an oil-in-water type dispersion of a hydrophobic photographically useful substance is disclosed, in which the dispersion is prepared by emulsifying and dispersing a solution (A) of at least one water-insoluble and organic solvent-soluble polymer in a substantially water-immiscible organic solvent and a solution (B) of at least one hydrophobic photographically useful substance in a substantially water-immiscible organic solvent in an aqueous medium (C) either simultaneously or separately. The dispersion has improved stability with time, and the photographically useful substance in the dispersed particles exhibits improved stability to light or heat in the photographic material.

10 Claims, No Drawings

SILVER HALIDE PHOTOGRAPHIC MATERIAL COMPRISING AN OIL-IN-WATER TYPE DISPERSION

This is a continuation of application Ser. No. 07/643,610 filed January 22, 1991, now abandoned.

FIELD OF THE INVENTION

This invention relates to a silver halide photographic material containing an emulsified dispersion comprising a hydrophobic photographically useful substance and a polymer.

BACKGROUND OF THE INVENTION

In the preparation of an oil drop dispersion containing a hydrophobic photographically useful substance, such as couplers, ultraviolet absorbents, and high boiling organic solvents, a commonly and widely employed method comprises dissolving such a hydrophobic substance in an auxiliary solvent and emulsifying and dispersing the solution in an aqueous medium as disclosed in U.S. Pat. No. 2,327,027. However, the dispersion prepared by this method is apt to undergo precipitation of the hydrophobic substance or change in particle size of the dispersed lipophilic fine particles when it is preserved in the dissolved state or at a low temperature.

Other available methods include a method of impregnating a hydrophobic substance into a latex polymer. For example, there is a method in which a hydrophobic substance, e.g., an oil-soluble coupler, is dissolved in a water-miscible organic solvent and loaded on latex particles obtained by emulsion polymerization as disclosed in U.S. Pat. No. 4,203,716; and a method in which a hydrophobic substance is dissolved in a substantially water-immiscible organic solvent and loaded on latex particles by emulsifying and dispersing as disclosed in JP-B-51-39853 (the term "JP-B" as used herein refers to an "examined Japanese patent publication").

These methods have difficulty in uniformly loading the hydrophobic substance on latex particles with good reproducibility.

WO 88/00723 and JP-A-63-264748 (the term "JP-A" as used herein refers to a "published unexamined Japanese patent application") disclose a method using a dispersion prepared by dispersing a mixed solution having dissolved therein a hydrophobic substance together with a water-insoluble and organic solvent-soluble polymer. According to this method, the lipophilic fine particles have improved stability, and the hydrophobic substance per se in the dispersion used in a photographic light-sensitive material exhibits improved stability to light and heat. It turned out, however, that the method disclosed in WO 88/00723 and JP-A-63-264748 has the following disadvantages in practical use. Firstly, simultaneous dissolving of a hydrophobic substance and a polymer requires a longer time than in the case of separately dissolving each of them. Secondly, since a mixed solution comprising a hydrophobic substance and a polymer exhibits high viscosity probably attributed to a strong interaction between them, it is hardly dispersed and liable to produce coarse particles. As a result, color developability or coating properties tend to be reduced. Moreover, when the resulting dispersion is preserved in a dissolved state or at a low temperature, the lipophilic fine particles are sometimes observed to become coarse. Thirdly, stability of the hydrophobic substance in lipophilic fine particles to light and heat is fairly improved, but there is a need for further improvement for practical use.

SUMMARY OF THE INVENTION

Accordingly, an object of the present invention is to eliminate the above described disadvantages.

Namely, one object of the present invention is to make it easy to prepare a dispersion of lipophilic fine particles containing a polymer.

Another object of the present invention is to improve stability of such a lipophilic fine particle dispersion with time and stability of a hydrophobic photographically useful substance per se contained in the lipophilic fine particles.

A further object of the present invention is to provide a silver halide photographic material containing such an improved dispersion of lipophilic fine particles.

The above objects of the present invention are now accomplished by:

(1) A silver halide photographic material containing an oil-in-water type (hereinafter referred to as O/W) dispersion which is prepared by emulsifying and dispersing a solution (A) of at least one water-insoluble and organic solvent-soluble polymer in a substantially water-immiscible organic solvent and a solution (B) of at least one hydrophobic photographically useful substance in a substantially water-immiscible organic solvent in an aqueous medium (C) either simultaneously or separately. (2) A silver halide photographic material according to (1) above, wherein said O/W dispersion is a dispersion prepared by first dispersing solution (A) in the aqueous medium and then dispersing solution (B) in the resulting dispersion.

(3) A silver halide photographic material according to (1) or (2) above, wherein said polymer comprises a repeating unit having a $>C{=}O$ bond.

DETAILED DESCRIPTION OF THE INVENTION

To accomplish the objects of the present invention, it is preferable to use a dispersion prepared through at least two stages of dispersing.

Preferred examples of such a dispersion include (1) a dispersion obtained by mixing solution (A) and an aqueous medium, followed by emulsifying and dispersing, and adding solution (B) to the resulting dispersion, followed by emulsifying and dispersing; (2) a dispersion obtained by mixing the whole amount of solution (A) and a part of solution (B), followed by emulsifying and dispersing, and then emulsifying and dispersing the remainder of solution (B) in the resulting dispersion; and (3) a dispersion obtained by mixing solution (B) and an aqueous medium, followed by emulsifying and dispersing, and then emulsifying and dispersing solution (A) in the resulting dispersion.

More preferred of them are dispersions (1) and (2) above. It should be noted that the dispersion which can be used in the present invention is not limited to these preferred embodiments.

Two or more different kinds of Solution (A) or solution (B) may be emulsified and dispersed. The photographically useful substances, polymers, etc., which are dissolved in the plurality of solutions (A) or (B) may be the same or different compounds or a mixture of two or more compounds.

Examples of hydrophobic photographically useful substances which can be used in the present invention include photographic couplers (e.g., yellow couplers, magenta couplers, cyan couplers, colorless couplers), compounds inhibiting color fog or discoloration of a developed color image (e.g., alkylhydroquinones or mono- or dialkyl ethers thereof, alkylphenols, chromans, coumarans, hindered amines, transition metal complexes), hardening agents, oil-soluble filter dyes, oil-soluble antihalation dyes, high boiling organic solvents, oil-soluble ultraviolet absorbents, fluorescent brightening agents, development inhibitor-releasing (DIR) compounds (e.g., DIR couplers, DIR hydroquinones), developing agents, diffusible dye-releasing (DDR) compounds, dye-releasing redox (DRR) compounds, dye developing agents, development inhibitors, development accelerators, and precursors thereof. Preferred of these are photographic couplers, color fog or discoloration inhibitors, oil-soluble ultraviolet absorbents, oil-soluble filter dyes, oil-soluble antihalation dyes, and high boiling organic solvents.

Where the present invention is applied to color light-sensitive materials, photographic couplers which are usually used include yellow, magenta and cyan couplers which develop yellow, magenta and cyan colors, respectively, upon coupling with an oxidation product of an aromatic amine color developing agent.

Cyan couplers, magenta couplers, and yellow couplers which are preferably used in the present invention are those represented by formulae (C-I), (C-II), (M-I), (M-II), and (Y) shown below.

(C-I)

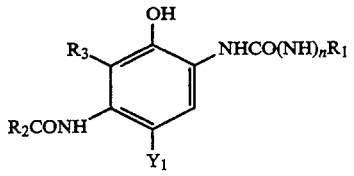

(C-II)

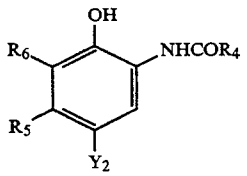

(M-I)

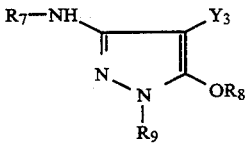

(M-II)

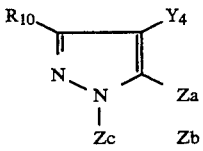

(Y)

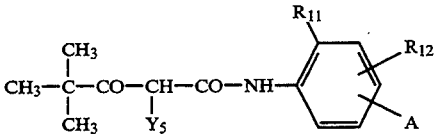

In formulae (C-I) and (C-II), $R_1$, $R_2$, and $R_4$ each represents a substituted or unsubstituted aliphatic, aromatic or heterocyclic group; $R_3$, $R_5$, and $R_6$ each represents hydrogen, a halogen, an aliphatic group, an aromatic group or an acylamino group; or $R_3$ represents a nonmetal atomic group forming a 5- or 6-membered nitrogen-containing ring together with $R_2$; $Y_1$ and $Y_2$ each represents hydrogen or a group releasable on coupling reaction with an oxidation product of a developing agent; and n represents 0 or 1.

$R_5$ in formula (C-II) preferably represents an aliphatic group, e.g., methyl, ethyl, propyl, butyl, pentadecyl, t-butyl, cyclohexyl, cyclohexylmethyl, phenylthiomethyl, dodecyloxyphenylthiomethyl, butanamidomethyl, and methoxymethyl groups.

Of the cyan couplers represented by formula (C-I) or (C-II), the following compounds are preferred.

In formula (C-I), $R_1$ preferably represents an aryl group or a heterocyclic group, and more preferably an aryl group substituted with a halogen, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. When $R_3$ and $R_2$ do not form a ring, $R_2$ preferably represents a substituted or unsubstituted alkyl or aryl group, and more preferably an alkyl group substituted with a substituted aryloxy group, and $R_3$ preferably represents hydrogen.

In formula (C-II), $R_4$ preferably represents a substituted or unsubstituted alkyl or aryl group, and more preferably an alkyl group substituted with a substituted aryloxy group. $R_5$ preferably represents an alkyl group having from 2 to 15 carbon atoms or a methyl group having a substituent containing at least one carbon atom. Substituents for a methyl group preferably include an arylthio group, an alkylthio group, an acylamino group, an aryloxy group, and an alkyloxy group. $R_5$ more preferably represents an alkyl group having from 2 to 15 carbon atoms, and particularly from 2 to 4 carbon atoms. $R_6$ preferably represents hydrogen or a halogen, and more preferably chlorine or fluorine.

In formulae (C-I) and (C-II), $Y_1$ and $Y_2$ each preferably represents hydrogen, a halogen, an alkoxy group, an aryloxy group, an acyloxy group, or a sulfonamide group.

In formula (M-1), $R_7$ and $R_9$ each represents a substituted or unsubstituted aryl group; $R_8$ represents hydrogen, an aliphatic or aromatic acyl group, or an aliphatic or aromatic sulfonyl group; and $Y_3$ represents hydrogen or a releasable group. The substituents for the aryl group (preferably a phenyl group) as represented by $R_7$ or $R_9$ are the same as for $R_1$. When there are two or more substituents, they may be the same or different. $R_8$ preferably represents hydrogen, an aliphatic acyl group, or an aliphatic sulfonyl group, and more preferably hydrogen. $Y_3$ preferably represents a group releasable at any of sulfur, oxygen and nitrogen atoms. For example, sulfur-releasable groups as described in U.S. Pat. No. 4,351,897 and International Publication WO 88/04795 are particularly preferred.

In formula (M-II), $R_{10}$ represents hydrogen or a substituent; $Y_4$ represents hydrogen or a releasable group, and preferably a halogen or an arylthio group; Za, Zb, and Zc each represents a methine group , a substituted methine group, =N—, or —NH—; either one of the Za–Zb bond and Zb–Zc bond is a double bond, with the other being a single bond; when the Zb–Zc bond is a carbon-carbon double bond, it may be a part of an aromatic ring; and formula (M-II) may have a polymerized form inclusive of a dimer formed at any of $R_{10}$, $Y_4$, or a substituted methine group represented by Za, Zb or Zc.

Of the pyrazoloazole couplers of formula (M-II), imidazo[1,2-b]pyrazoles described in U.S. Pat. No. 4,500,630 are preferred in view of reduced yellow side absorption and stability to light. Pyrazolo[1,5-b]-[1,2,4]triazoles described in U.S. Pat. No. 4,540,654 are particularly preferred.

Additional examples of suitable pyrazoloazole couplers include pyrazolotriazole couplers having a branched alkyl group at the 2-, 3- or 6-position of the pyrazolotriazole ring as described in JP-A-61-65245; pyrazoloazole couplers containing a sulfonamido group in the molecule thereof as described in JP-A-61-65246; pyrazoloazole couplers having an alkoxyphenylsulfonamido ballast group as described in JP-A-61-147254; and pyrazolotriazole couplers having an alkoxy group or an aryloxy group at the 6-position as described in European Patent Publication Nos. 226,849 and 294,785.

In formula (Y), $R_11$ represents a halogen, an alkoxy group, a trifluoromethyl group, or an aryl group; $R_{12}$ represents hydrogen, a halogen, or an alkoxy group; A represents $—NHCOR_{13}$, $—NHSO_2—R_{13}$, $—SO_2NHR_{13}$, $—COOR_{13}$, or $$—SO_2\underset{\underset{R_{14}}{|}}{N}—R_{13}$$

(wherein $R_{13}$ and $R_{14}$ each represents an alkyl group, an aryl group, or an acyl group); and $Y_5$ represents a releasable group. The substituents for $R_{12}$, $R_{13}$, or $R_{14}$ are the same as for $R_1$. The releasable group $Y_5$ is preferably a group releasable at an oxygen atom or a nitrogen atom, and more preferably a nitrogen-releasable group.

Specific examples of the couplers represented by formulae (C-I), (C-II), (M-I), (M-II), and (Y) are shown below.

(C-1)
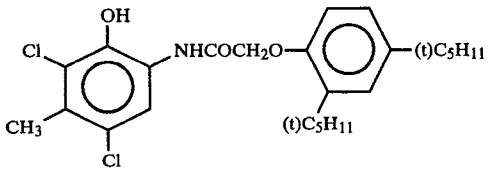
(C-2)
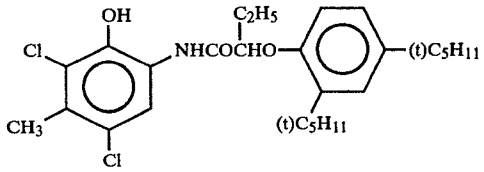
(C-3)
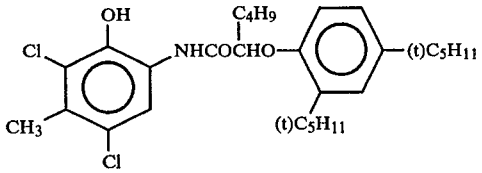
(C-4)
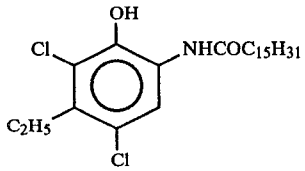
(C-5)
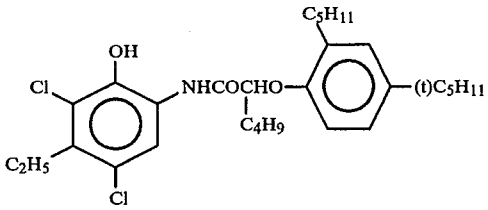
(C-6)
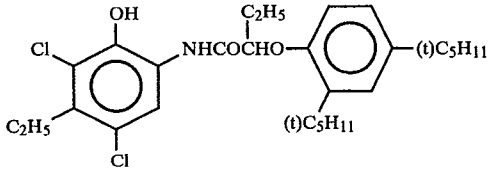
(C-7)
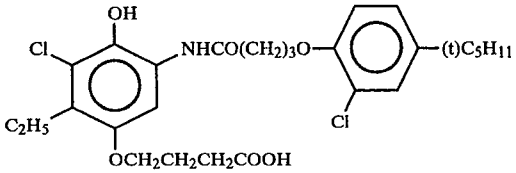
(C-8)
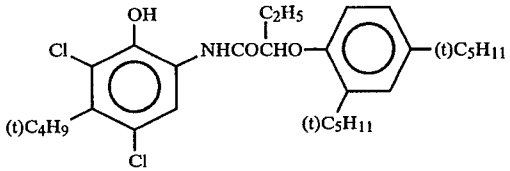
(C-9)
(C-10)

-continued
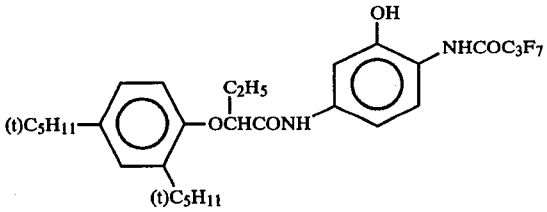
(C-11)
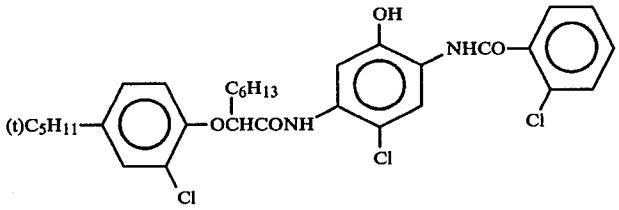
(C-12)
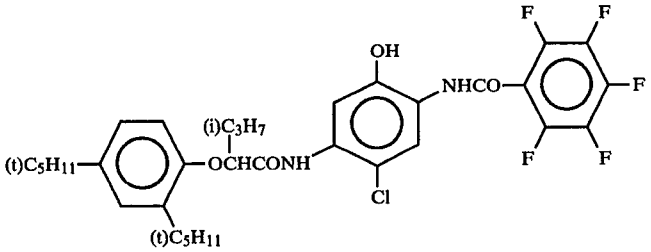
(C-13)
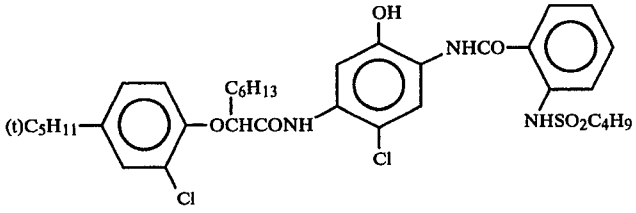
(C-14)
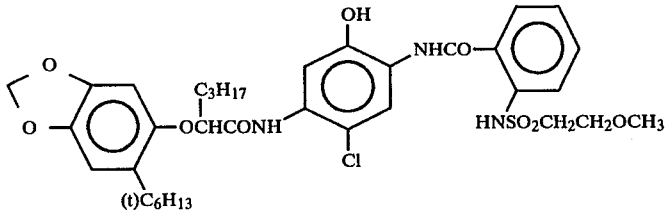
(C-15)
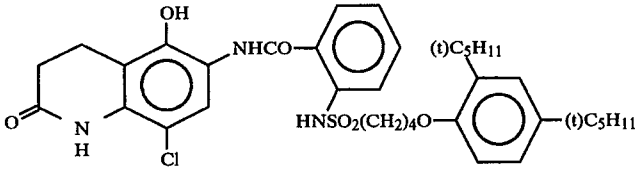
(C-16)
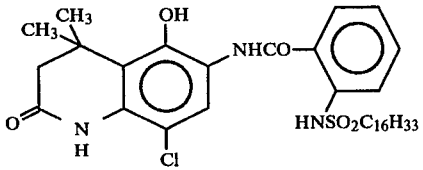
(C-17)
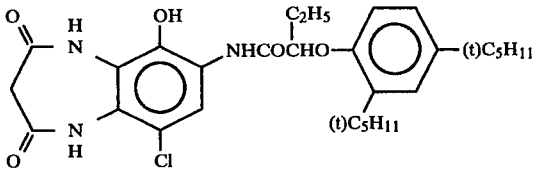
(C-18)

-continued
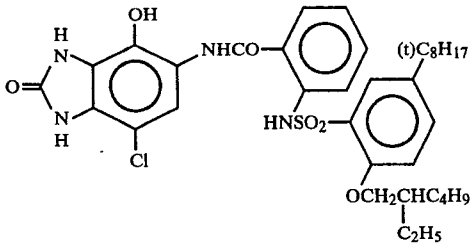
(C-19)
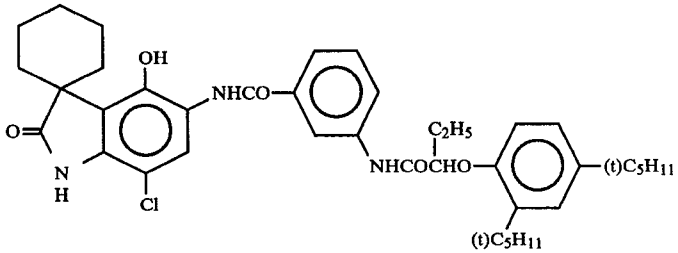
(C-20)
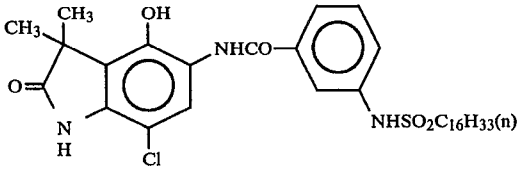
(C-21)
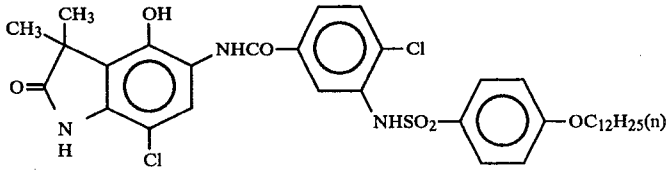
(C-22)
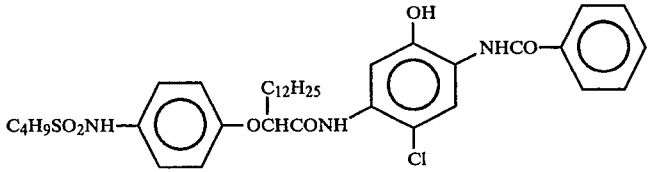
(M-1)
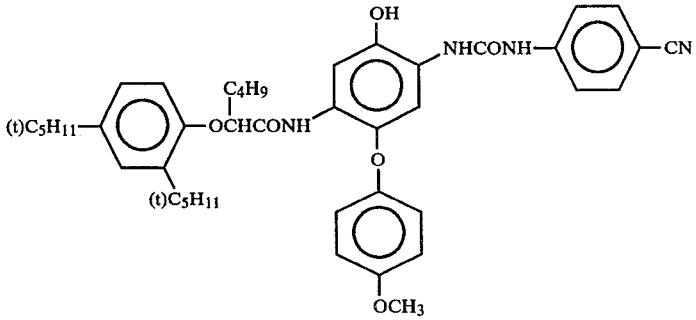
(M-2)

-continued
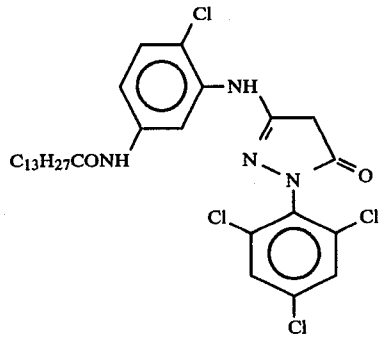
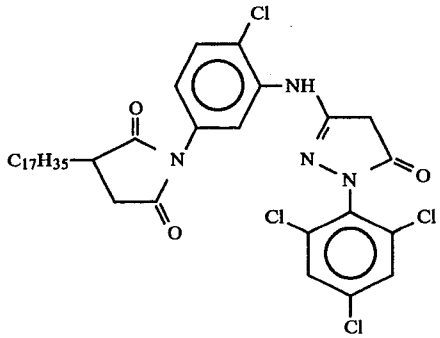
(M-3)
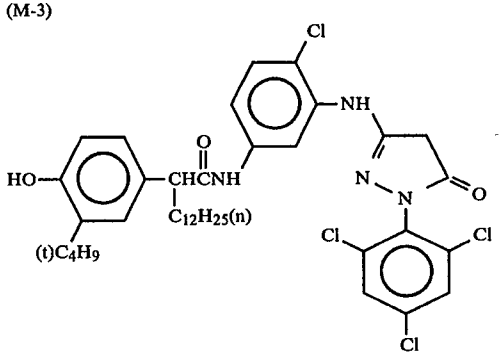
(M-4)
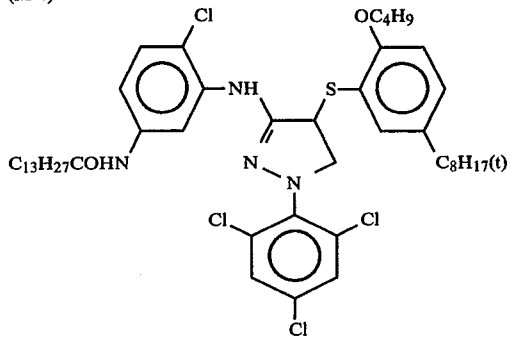
(M-5)
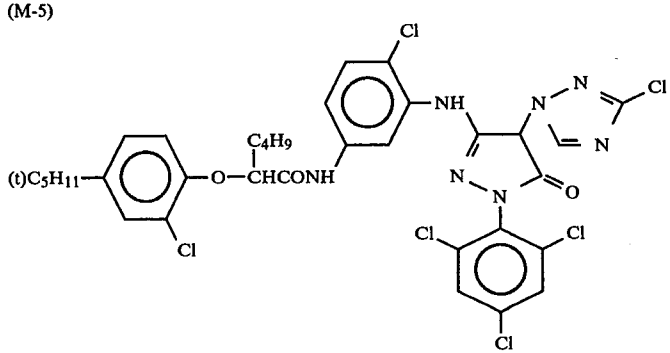
(M-6)
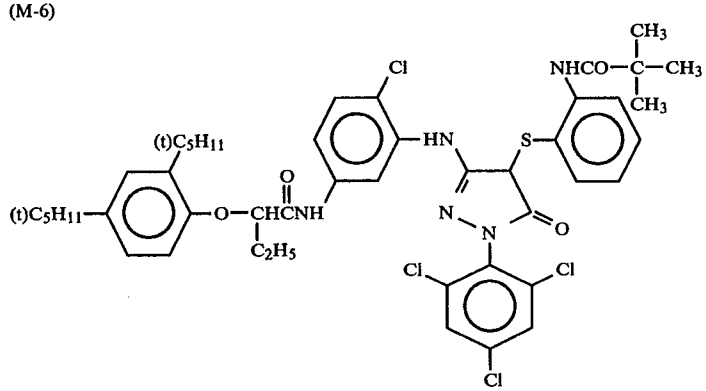

-continued
(M-7)
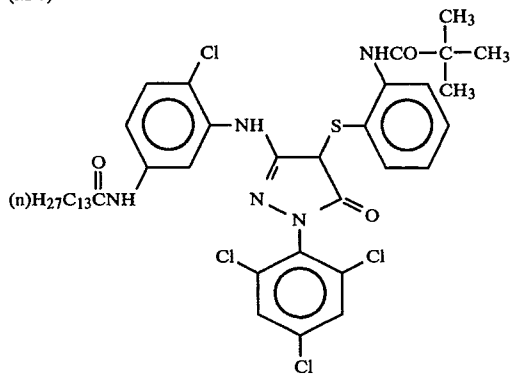
(M-8)
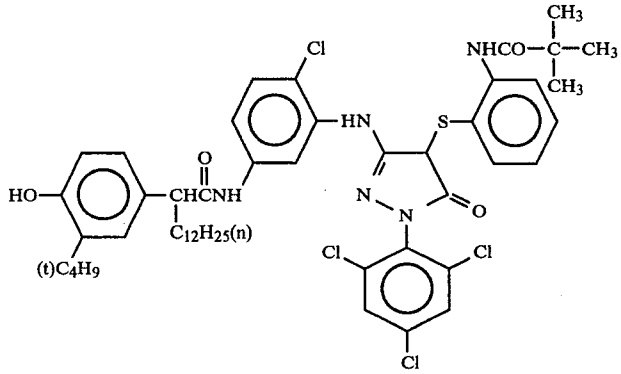
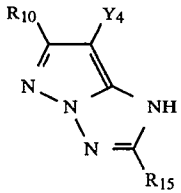
| Compound | $R_{10}$ | $R_{15}$ | $Y_4$ |
|---|---|---|---|
| M-9 | $CH_3$— | 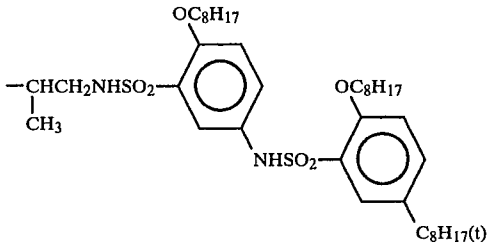 | Cl |
| M-10 | " | 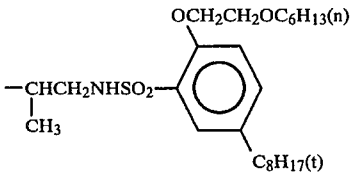 | " |

-continued
| | | | |
|---|---|---|---|
| M-11 | $(CH_3)_3C-$ | 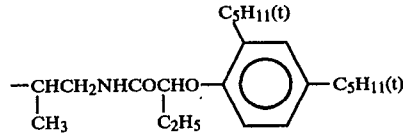 | 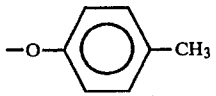 |
| M-12 | 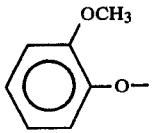 | 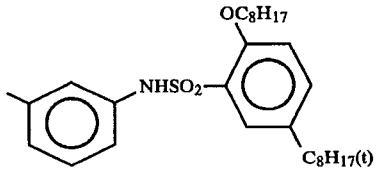 | 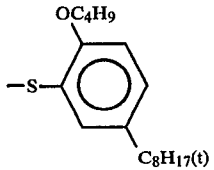 |
| M-13 | $CH_3-$ | 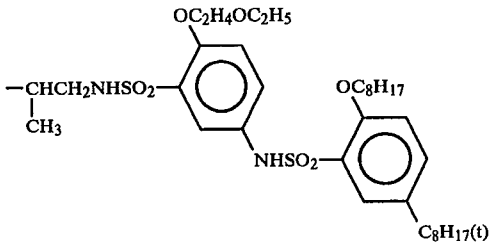 | Cl |
| M-14 | " | 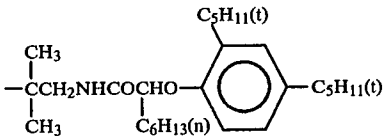 | " |
| M-15 | " | 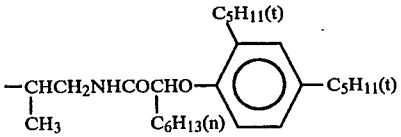 | " |
| M-16 | $CH_3-$ | 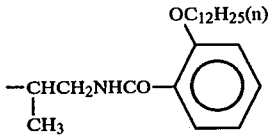 | Cl |

-continued
| | | | |
|---|---|---|---|
| M-17 | " | 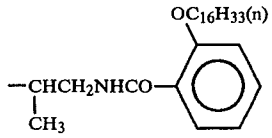 | " |
| M-18 | 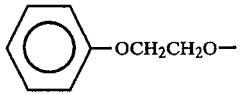 | 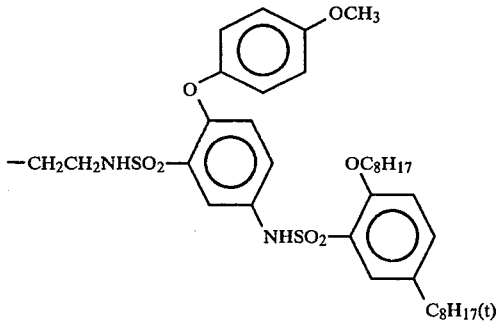 | 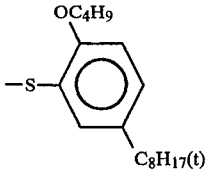 |
| M-19 | $CH_3CH_2O-$ | " | " |
| M-20 | 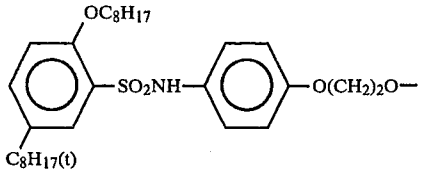 | 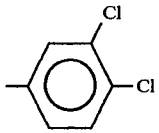 | 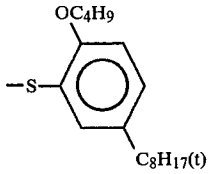 |
| M-21 | 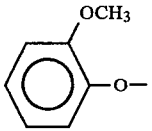 | 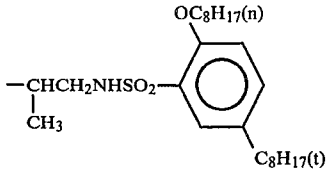 | Cl |
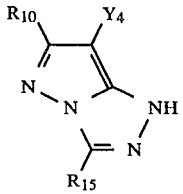

-continued
| | | | |
|---|---|---|---|
| M-22 | $CH_3$— | 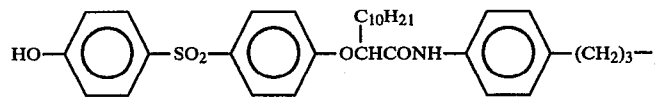 | Cl |
| M-23 | " | 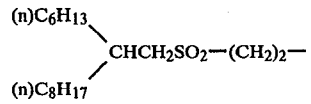 | " |
| M-24 | 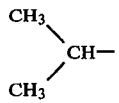 | 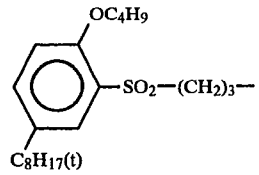 | " |
| M-25 | 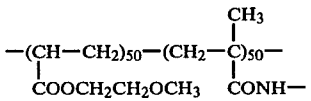 | 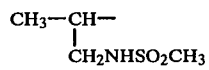 | " |
| M-26 | 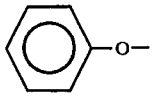 | 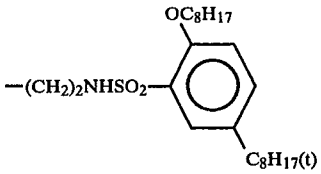 | Cl |
| M-27 | $CH_3$— | 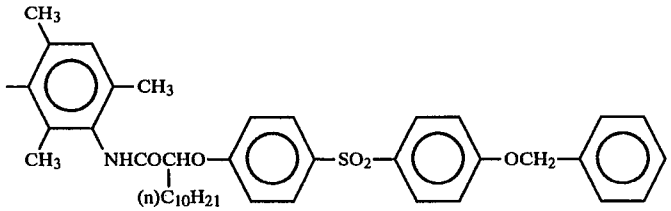 | " |

-continued
| | | | |
|---|---|---|---|
| M-28 | $(CH_3)_3C-$ | 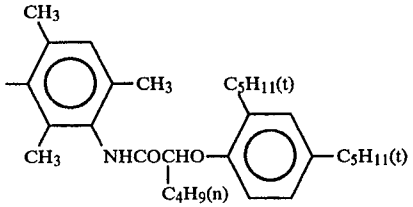 | " |
| M-29 | 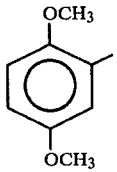 | 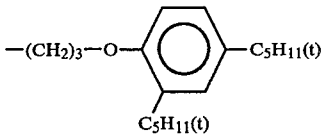 | Cl |
| M-30 | $CH_3-$ | 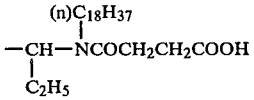 | " |
(Y-1)
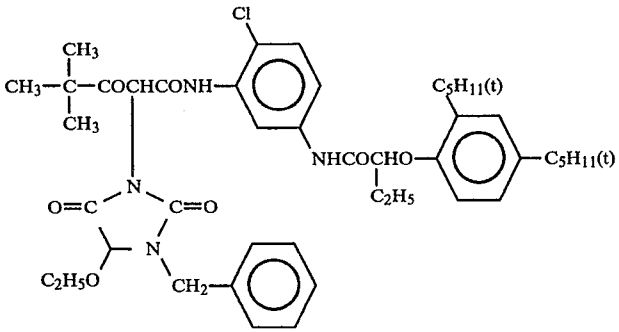
(Y-2)
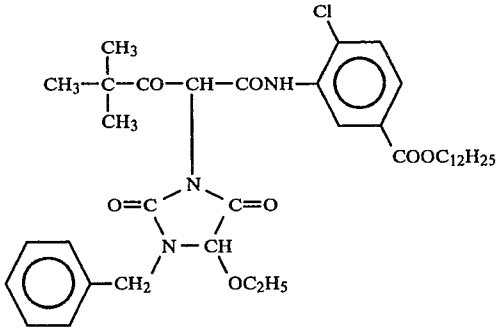
(Y-3)
(Y-4)

-continued
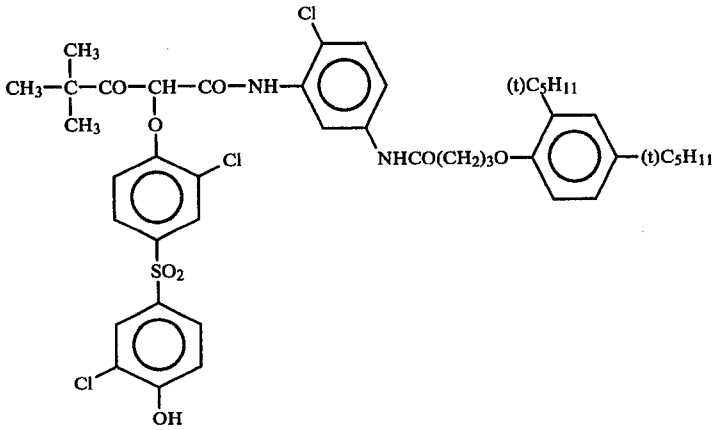
(Y-5)
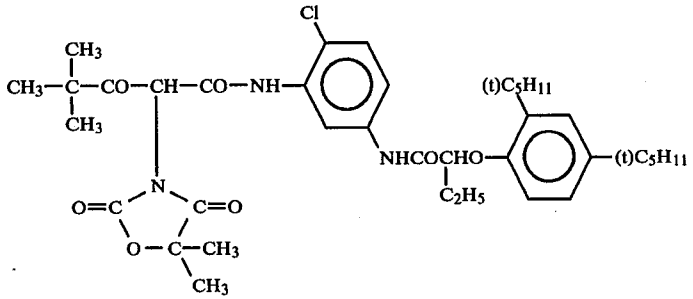
(Y-6)
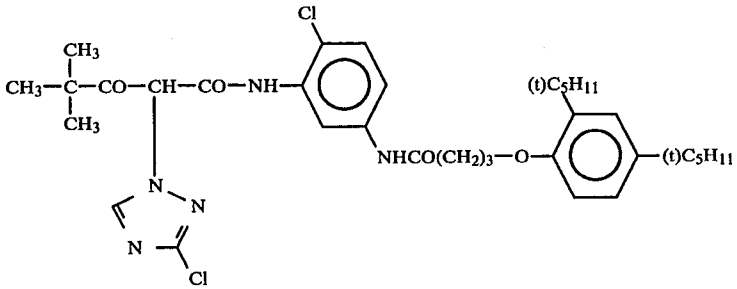
(Y-7)
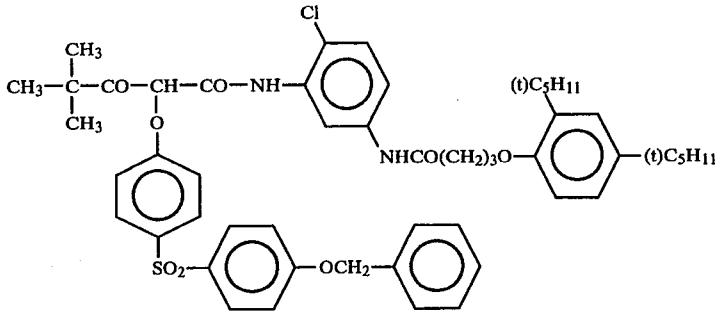
(Y-8)

-continued
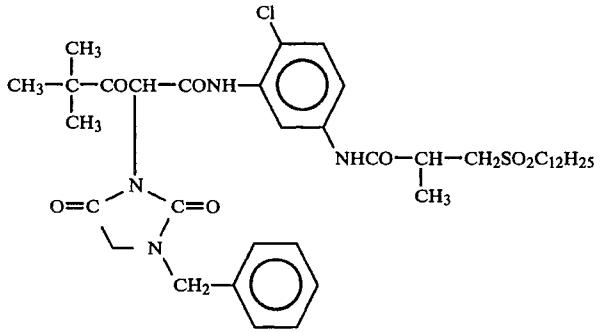
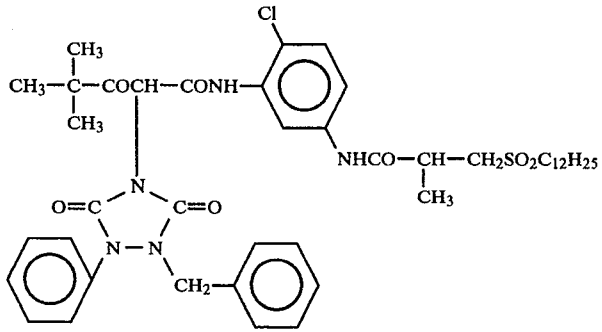
(Y-9)
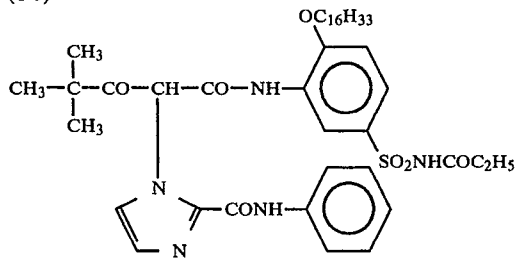

The couplers represented by formulae (C-I) through (Y) may be incorporated into a silver halide emulsion layer constituting a light-sensitive layer usually in an amount of from 0.1 to 1.0 mol, and preferably from 0.1 to 0.5 mol, per mol of silver halide.

Each of the cyan, magenta, and yellow couplers may be used either individually or in combination of two or more kinds thereof. Further, a mixture of two or more kinds of cyan, magenta, or yellow couplers may also be used.

High boiling organic solvents as photographically useful substance preferably include those having a dielectric constant of from 2 to 20 at 25° C. and a refractive index of from 1.5 to 1.7 at 25° C.

Preferred high boiling organic solvents are represented by the following formulae (A) to (E).

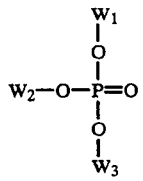
(A)

$W_1—COOW_2$ (B)

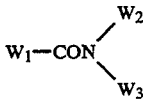
(C)

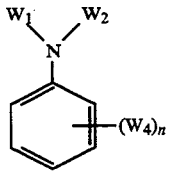
(D)

$W_1—O—W_2$ (E)

wherein $W_1$, $W_2$ and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $—OW_1$ or $—S—W_1$; n represents an integer of from 1 to 5; when n is 2 or more, the plural $W_4$ may be the same or different; $W_1$ and $W_2$ in formula (E) may form a condensed ring.

Besides the above described high boiling organic solvents of formulae (A) through (E), compounds having a melting point of not higher than 100° C. and a boiling point of not lower than 140° C. which are immiscible with water and are good solvents for couplers can also be used in the present invention. The high boiling organic solvents preferably have a melting point of not higher than 80° C. and a boiling point of not lower than 160° C., and more preferably not lower than 170° C.

The details for these high boiling organic solvents are described in JP-A-62-215272 and EP 0353714A2, pages 51 to 57.

Color fog inhibitors which can be used in the light-sensitive materials according to the present invention as hydrophobic photographically useful substances include hydroquinone derivatives, aminophenol derivatives, gallic acid derivatives, ascorbic acid derivatives, etc.

Discoloration inhibitors which can be used in the light-sensitive materials according to the present invention as hydrophobic photographically useful substance include organic discoloration inhibitors for cyan, magenta, and/or yellow images, such as hydroquinones, 6-hydroxychromans, 5-hydroxycoumarans, spirochromans, p-alkoxyphenols, hindered phenols including bisphenols, gallic acid derivatives, methylenedioxybenzenes, aminophenols, hindered amines, and ether or ester derivatives of these phenol compounds obtained by silylating or alkylating the phenolic hydroxyl group thereof; and metal complexes, such as bissalicylaldoximatonickel complexes and bis-N,N-dialkyldithiocarbamatonickel complexes.

Specific examples of these discoloration inhibitors are described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028 as for hydroquinones; U.S. Pat. Nos. 3,432,300, 3,573,050, 3,574,627, 3,698,909, and 3,764,337, and JP-A-52-152225 as for 6-hydroxychromans, 5-hydroxycoumarans, and spirochromans; U.S. Pat. No. 4,360,589 as for spiroindanes; U.S. Pat. No. 2,735,765, British Patent 2,066,975, JP-A-59-10539, and JP-B-57-19765 as for p-alkoxyphenols; U.S. Pat. No. 3,700,455, JP-A-52-72224, U.S. Pat. No. 4,228,235, and JP-B-52-6623 as for hindered phenols; U.S. Pat. Nos. 3,457,079 and 4,332,886, and JP-B-56-21144 as for gallic acid derivatives, methylenedioxybenzenes, and aminophenols; U.S. Pat. Nos. 3,336,135 and 4,268,593, British Patents 1,326,889, 1,354,313, and 1,410,846, and JP-B-51-1420, JP-A-58-114036, JP-A-59-53846, and JP-A-59-78344 as for hindered amines; and U.S. Pat. Nos. 4,050,938 and 4,241,155 and British Patent 2,027,731(A) as for metal complexes. These compounds are coemulsified together with corresponding couplers in an amount usually of from 5 to 100% by weight based on the couplers and added to a light-sensitive layer.

For preventing fading of a cyan dye image due to heat and particularly light, it is more effective to incorporate an ultraviolet absorbent (hydrophobic photographically useful substance) into a cyan-forming layer and both adjacent layers.

Examples of suitable ultraviolet absorbents include benzotriazole compounds having an aryl substituent as described, e.g., in U.S. Pat. No. 3,533,794; 4-thiazolidone compounds as described, e.g., in U.S. Pat. Nos. 3,314,794 and 3,352,681; benzophenone compounds as described, e.g., in JP-A-46-2784; cinnamic ester compounds as described, e.g., in U.S. Pat. Nos. 3,705,805 and 3,707,395; butadiene compounds as described, e.g., in U.S. Pat. No. 4,045,229; and benzoxazole compounds as described, e.g., in U.S. Pat. Nos. 3,406,070, 3,677,672, and 4,271,307. Ultraviolet absorbing couplers (e.g., α-naphthol type cyan-forming couplers) or ultraviolet absorbing polymers are also useful. These ultraviolet absorbents may be mordanted in a specific layer. Of these ultraviolet absorbents, preferred are benzotriazole compounds having an aryl substituent.

Ultraviolet absorbents which can be used in the present invention are shown in Tables 1 and 2 below for illustrative purposes only but not for limitation.

TABLE 1

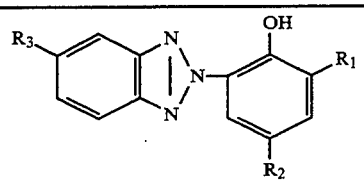

(UV-1)

| Compound No. | $R_3$ | $R_1$ | $R_2$ |
|---|---|---|---|
| UV-1 | H | H | $-C_4H_9(t)$ |
| UV-2 | H | H | $-C_{12}H_{25}(n)$ |
| UV-3 | H | H | $-CH_2CH_2COOC_8H_{17}$ |
| UV-4 | Cl | H | $-C_5H_{11}(t)$ |
| UV-5 | Cl | H | $-CH_2CH_2COOC_8H_{17}$ |
| UV-6 | H | $-C_4H_9(sec)$ | $-C_4H_9(t)$ |
| UV-7 | H | $-C_5H_{11}(t)$ | $-C_5H_{11}(t)$ |
| UV-8 | H | $-C_4H_9(t)$ | $-CH_2CH_2COOC_8H_{17}$ |
| UV-9 | H | $-CH_3$ | $-C_4H_9(t)$ |
| UV-10 | Cl | $-C_4H_9(t)$ | $-C_4H_9(t)$ |
| UV-11 | Cl | $-C_4H_9(sec)$ | $-C_4H_9(t)$ |
| UV-12 | Cl | $-C_4H_9(t)$ | $-CH_2CH_2COOC_8H_{17}$ |
| UV-13 | $-OCH_3$ | $-C_4H_9(sec)$ | $-C_4H_9(t)$ |
| UV-14 | $-C_4H_9(sec)$ | $-C_4H_9(t)$ | $-CH_2CH_2COOC_8H_{17}$ |
| UV-15 | $-C_6H_5$ | $-C_5H_{11}(t)$ | $-C_5H_{11}(t)$ |

TABLE 2

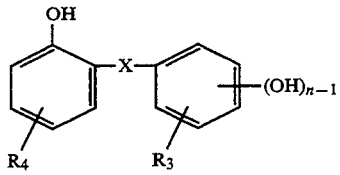

(UV-11)

| Compound No. | X | $R_4$ | $R_5$ | n | Position of —(OH) |
|---|---|---|---|---|---|
| UV-16 | —CO— | 5-$OC_4H_9$ | H | 1 | |
| UV-17 | " | 5-$OC_8H_{17}$ | H | 1 | |
| UV-18 | " | 5-$OC_{16}H_{33}$ | H | 1 | |
| UV-19 | " | 5-$OC_{18}H_{37}$ | H | 1 | |
| UV-20 | " | 4-$OC_4H_9$ | 4'-$OCH_3$ | 3 | 2'-, 5'- |
| UV-21 | " | 5-$COCH_3$ | 3'-$C_8H_{17}$ | 3 | 2'-, 6'- |
| UV-22 | " | 5-$C_{12}H_{25}$ | 4'-$COCH_3$ | 2 | 2'- |
| UV-23 | " | 5-$COCH_3$ | 3'-$C_8H_{17}$ | 3 | 2'-, 6'- |
| UV-24 | " | 4-$OC_{12}H_{25}$ | 4'-$OCH_2C_6H_4$-(p)$CH_3$ | 2 | 2'- |
| UV-25 | " | 5-$C_8H_{17}$ | 4'-$COC_6H_4$-(p)$CH_3$ | 3 | 2'-, 6'- |
| UV-26 | —COO— | 4-$C_{12}H_{25}$ | 4'-$C_4H_9(t)$ | 1 | |
| UV-27 | " | H | 4'-$C_4H_9(t)$ | 1 | |
| UV-28 | " | 4-$OC_{12}H_{25}$ | 5'-$OCH_3$ | 2 | 2'- |
| UV-29 | " | 3-$OCH_3$ | 5'-$OC_{12}H_{25}$ | 2 | 2'- |

The above described couplers, particularly pyrazoloazole couplers are preferably used in combination with (F) a compound capable of chemically bonding to a residual aromatic amine developing agent remaining after color development to form a chemically inactive and substantially colorless compound and/or (G) a compound capable of chemically bonding to a residual oxidation product of an aromatic amine developing agent remaining after color development to form a chemically inactive and substantially colorless compound. Such a combined use is favorable for prevention of staining and other side effects during preservation after processing which are due to color formation reaction between any residual color developing agent or an oxidation product thereof and the coupler.

Compounds (F) preferably include compounds which react with p-anisidine with a rate constant of a second order reaction $k_2$ falling within a range of from 1.0 liter/mol.sec to $1\times10^{-5}$ liter/mol.sec (in trioctyl phosphate at 80° C.). The rate constant can be determined by the method described in JP-A-63-158545.

When $k_2$ is greater than the above range, the compound per se becomes labile and apt to decompose on reacting with gelatin or water. Where $k_2$ is smaller than that range, the reaction with a residual aromatic amine developing agent is too slow to prevent side effects of the residual aromatic amine developing agent.

Preferred of compounds (F) are those represented by formula (FI) and (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 1 or 0; A represents a group capable of reacting with an aromatic amine developing agent to form a chemical bond; X represents a group which is released on reacting with an aromatic amine developing agent; B represents hydrogen, an aliphatic group, an aromatic group, a heterocyclic group, an acyl group, or a sulfonyl group; and Y represents a group which accelerates addition of an aromatic amine developing agent to the compound (FII); and $R_1$ and X, or Y and $R_2$ or B may link to form a cyclic structure.

The mode of chemically bonding to a residual aromatic amine developing agent typically includes a substitution reaction and an addition reaction.

Specific examples of the compounds of formulae (FI) and (FII) preferably include those described in JP-A-63-158545, JP-A-62-283338, and European Patent Laid-Open Nos. 298321 and 277589.

Compounds (G) preferably include those represented by formula (GI):

$$R\text{-}Z \quad \text{(GI)}$$

wherein R represents an aliphatic group, an aromatic group, or a heterocyclic group; and Z represents a nucleophilic group or a group capable of releasing a nucleophilic group on decomposition in a light-sensitive material.

In formula (GI), Z is preferably a group having a Pearson's nucleophilicity $^{n}CH_3I$ value (see R. G. Pearson, et al., *J. Am. Chem. Soc.*, Vol. 90, p. 319 (1968)) of 5 or more or a group derived therefrom.

Specific examples of the compound represented by formula (GI) preferably include those described in European Patent Laid-Open No. 255722, JP-A-62-143048, JP-A-62-229145, Japanese Patent Application Nos. Sho-63-36724 and Sho-62-214681, European Patent Laid-Open Nos. 298321 and 277589.

Combinations of compounds (G) and compounds (F) are described in detail in European Patent Laid-Open No. 277589.

Hydrophilic colloidal layers of the light-sensitive material may contain water-soluble dyes or dyes which become water-soluble by photographic processing as a filter dye or for the purpose of preventing irradiation or halation or for other various purposes. Such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

Dyes which are preferably used in the present invention are described in WO 88/04794, EP 0274723A1, 0299435A2 and 0337490A2, JP-A-55-155351, JP-A-56-12639, U.S. Patent 4,276,373, JP-A-55-155350, EP 0,323,728A2 and 0,323,729A2, JP-A-52-92716, JP-A-55-120030, JP-A-63-27838, EP 0,276,566A1, and U.S. Pat. No. 4,803,150.

Water-insoluble and organic solvent-soluble hydrophobic polymers which can be used in the present invention preferably include those comprising at least one repeating unit containing a C=O bond in the main chain or side chain thereof, and more preferably, those comprising at least one repeating unit containing a

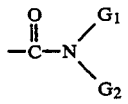

represents hydrogen, a substituted or unsubstituted alkyl group inclusive of straight chain, branched, and cyclic alkyl groups, or an aryl group and $G_2$ represents the same alkyl group or aryl group as for $G_1$) in its side chain.

While any kind of polymers may be used in the present invention as far as they are insoluble in water and soluble in organic solvents, preferably the polymers are completely soluble in ethyl acetate at a temperature of 20° C. and have a solubility of not more than 5% by weight in water at a temperature of 20° C., and those having a repeating unit containing a >C=O bond are preferred from the standpoint of improving effects on color developability and discoloration resistance.

Specific examples of the polymers to be used in the present invention are described below for illustrative purposes only but not for limitation.

(A) Vinyl Polymers:

Monomers constituting vinyl polymers include acrylic esters, e.g., methyl acrylate, ethyl acrylate, n-propyl acrylate, isopropyl acrylate, n-butyl acrylate, isobutyl acrylate, sec-butyl acrylate, t-butyl acrylate, amyl acrylate, hexyl acrylate, 2-ethylhexyl acrylate, octyl acrylate, t-octyl acrylate, 2-chloroethyl acrylate, 2-bromoethyl acrylate, 4-chlorobutyl acrylate, cyanoethyl acrylate, 2-acetoxyethyl acrylate, dimethylaminoethyl acrylate, benzyl acrylate, methoxybenzyl acrylate, 2-chlorocyclohexyl acrylate, cyclohexyl acrylate, furfuryl acrylate, tetrahydrofurfuryl acrylate, phenyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-isopropoxyethyl acrylate, 2-butoxyethyl acrylate, 2-(2-methoxyethoxy)ethyl acrylate, 2-(2-butoxyethoxy)ethyt acrylate, ω-methoxypolyethylene glycol acrylate (number of mols added n=9), 1-bromo-2-methoxyethyl acrylate, and 1,1-dichloro-2-ethoxyethyl acrylate; methacrylic esters, e.g., methyl methacrylate, ethyl methacrylate, n-propyl methacrylate, isopropyl methacrylate, n-butyl methacrylate, isobutyl methacrylate, sec-butyl methacrylate, t-butyl methacrylate, amyl methacrylate, hexyl methacrylate, cyclohexyl methacrylate, benzyl methacrylate, chlorobenzyl methacrylate, octyl methacrylate, stearyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, naphthyl methacrylate, 2-hydroxyethyl methacrylate, 4-hydroxybutyl methacrylate, triethylene glycol monomethacrylate, dipropylene glycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene glycol methacrylate (number of mol added n=6), allyl methacrylate, and dimethylaminoethylmethyl methacrylate chloride; vinyl esters, e.g., vinyl acetate, vinyl propionate, vinyl butyrate, vinyl isobutyrate, vinyl caproate, vinyl chloroacetate, vinyl methoxyacetate, vinylphenyl acetate, vinyl benzoate, and vinyl salicylate; acrylamides, e.g., acrylamide, methylacrylamide, ethylacrylamide, propylacrylamide, butylacrylamide, t-butylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide, N-(2-acetoacetoxyethyl)acrylamide, and diacetonacrylamide; methacrylamides, e.g., methacrylamide, methylmethacrylamide, ethylmethacrylamide, propylmethacrylamide, butylmethacrylamide, t-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide, and N-(2-acetoacetoxyethyl)methacrylamide; olefins, e.g., dicyclopentadiene, ethylene, propylene, 1-butene, 1-pentene, vinyl chloride, vinylidene chloride, isoprene, chloroprene, butadiene, 2,3-dimethylbutadiene; styrenes (e.g., styrene, methylstyrene, dimethylstyrene, trimethylstyrene, ethylstyrene, isopropylstyrene, chloromethylstyrene, methoxystyrene, acetoxystyrene, chlorostyrene, dichlorostyrene, and bromostyrene), and methyl vinyl benzoate; vinyl ethers, e.g., methyl vinyl ether, butyl vinyl ether, hexyl vinyl ether, methoxyethyl vinyl ether, and dimethylaminoethyl vinyl ether; butyl crotonate, hexyl crotonate, dimethyl itaconate, dibutyl itaconate, diethyl maleate, dimethyl maleate, dibutyl maleate, diethyl fumarate, dimethyl fumarate, dibutyl fumarate, methyl vinyl ketone, phenyl vinyl ketone, methoxyethyl vinyl ketone, glycidyl acrylate, glycidyl methacrylate, N-vinyloxazolidone, N-vinylpyrrolidone, acrylonitrile, methacrylonitrile, methylenemalonitrile, and vinylidene.

The vinyl polymers may contain two or more vinyl monomers selected from the above enumerated monomers and others for various purposes, such as for improving dissolving properties. For the purpose of controlling color developability or dissolving properties, the vinyl polymers may further contain comonomers having an acidic group as far as the copolymer does not become water-soluble. Examples of such comonomers include acrylic acid, methacrylic acid, itaconic acid, maleic acid, monoalkyl itaconates (e.g., monomethyl itaconate, monoethyl itaconate, and monobutyl itaconate), monoalkyl maleates (e.g., monomethyl maleate, monoethyl maleate, and monobutyl maleate), citraconic acid, styrenesulfonic acid, vinylbenzylsulfonic acid, vinylsulfonic acid, acryloyloxyalkylsulfonic acids (e.g., acryloyloxymethylsulfonic acid, acryloyloxyethylsulfonic acid, and acryloyloxypropylsulfonic acid), methacryloyloxyalkylsulfonic acids (e.g., methacryloyloxymethylsulfonic acid, methacryloyloxyethyl sulfonic acid, and methacryloyloxypropylsulfonic acid), acrylamidoalkylsulfonic acids (e.g., 2-acrylamido-2-methylethanesulfonic acid, 2-acrylamido-2-methylpropanesulfonic acid, and 2-acrylamido-2-methylbutanesulfonic acid), and methacrylamidoalkylsulfonic acids (e.g., 2-methacrylamido-2-methylethanesulfonic acid, 2-methacrylamido-2-methyl propanesulfonic acid, and 2-methacrylamido-2-methylbutanesulfonic acid).

These acids may be in the form of a salt with an alkali metal (e.g., Na and K) or an ammonium ion.

Where hydrophilic vinyl monomers (which produce a water-soluble homopolymer) out of the above enumerated vinyl monomers and other vinyl monomers are used as comonomers, the copolymerization ratio of such hydrophilic vinyl monomers in the copolymer is not particularly limited as long as the resulting copolymer is water-insoluble. Usually, it is preferably not more than 40 mol %, more preferably not more than 20 mol %, and most preferably not more than 10 mol %. Where the hydrophilic monomers having an acidic group are used as comonomers, the copolymerization ratio is usually not more than 20 mol %, preferably not more than 10 mol %, and more preferably 0 mol %, from the standpoint of image preservability.

Preferred of the above described vinyl monomers are methacrylate monomers, acrylamide monomers, and methacrylamide monomers, with acrylamide monomers and methacrylamide monomers being particularly preferred.

(B) Polyester Resins Obtained by Condensation of Polyhydric Alcohol and Polybasic Acid:

Effective polyhydric alcohols include glycols or polyalkylene glycols having a structure of HO—$R_1$—OH, wherein $R_1$ represents a hydrocarbon chain having from 2 to about 12 carbon atoms, and particularly an aliphatic hydrocarbon chain. Effective polybasic acids include those having a structure of HOOC—$R_2$—COOH, wherein $R_2$ represents a single bond or a hydrocarbon chain having from 1 to about 12 carbon atoms.

Specific examples of polyhydric alcohols are ethylene glycol, diethylene glycol, triethylene glycol, 1,2-propylene glycol, 1,3-propylene glycol, trimethylolpropane, 1,4-butanediol, isobutylenediol, 1,5-pentanediol, neopentyl glycol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, glycerin, diglycerin, triglycerin, 1-methylglycerin, erythritol, mannitol, and sorbitol.

Specific examples of polybasic acids are oxalic acid, succinic acid, glutaric acid, adipic acid, pimelic acid, cork acid, azelaic acid, sebacic acid, nonanedicarboxylic acid, decanedicarboxylic acid, undecanedicarboxylic acid, dodecanedicarboxylic acid, fumaric acid, maleic acid, itaconic acid, citraconic acid, phthalic acid, isophthalic acid, terephthalic acid, tetrachlorophthalic acid, mesaconic acid, isopimelic acid, a cyclopentadiene-maleic anhydride adduct, and a rosin-maleic anhydride adduct.

(C) Other Polymers:

Polyesters obtained by ring-opening polymerization as illustrated below:

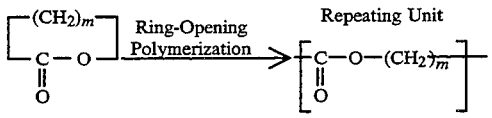

wherein m represents an integer of from 4 to 7; and the —$CH_2$— chain may have a branched structure.

Suitable monomers for preparing the above polyesters include $\beta$-propiolactone, $\epsilon$-caprolactone, and dimethylpropiolactone.

The above mentioned hydrophobic polymers may be used either individually or in combination of two or more thereof.

The polymers are preferably used at a weight ratio to the hydrophobic photographically useful substance of from 1/20 to 20/1, and more preferably from 10 to 10/1.

When the amount of the polymer added to the hydrophobic photographically useful substance is too small, coloring dyes and ultraviolet absorbers cannot effectively improve fastness and when it is too large there occurs a problem that the coupling rate of couplers decreases or the film properties undergo a change.

Specific but nonlimiting examples of the polymers which can be used in the present invention are shown below. Copolymerization ratios are given by weight.

P- 1) Poly(vinyl acetate)
P- 2) Poly(vinyl propionate)
P- 3) Poly(methyl methacrylate)
P- 4) Poly(ethyl methacrylate)
P- 5) Poly(ethyl acrylate)
P- 6) Vinyl acetate/vinyl alcohol copolymer (95/5)
P- 7) Poly(n-butyl acrylate)
P- 8) Poly(n-butyl methacrylate)
P- 9) Poly(isobutyl methacrylate)
P- 10) Poly(isopropyl methacrylate)
P- 11) Poly(decyl methacrylate)
P- 12) n-Butyl acrylate/acrylamide copolymer (95/5)
P- 13) Poly(methyl chloroacrylate)
P- 14) 1,4-Butanediol-adipic acid polyester
P- 15) Ethylene glycol-sebacic acid polyester
P- 16) Polycaprolactone
P- 17) Poly(2-t-butylphenyl acrylate)
P- 18) Poly(4-t-butylphenyl acrylate)
P- 19) n-Butyl methacrylate/N-vinyl-2-pyrrolidone copolymer (90/10)

P- 20) Methyl methacrylate/vinyl chloride copolymer (70/30)
P- 21) Methyl methacrylate/styrene copolymer (90/10)
P- 22) Methyl methacrylate/ethyl acrylate copolymer (50/50)
P- 23) n-Butyl methacrylate/methyl methacrylate/styrene copolymer (50/30/20)
P- 24) Vinyl acetate/acrylamide copolymer (85/15)
P- 25) Vinyl chloride/vinyl acetate copolymer (65/35)
P- 26) Methyl methacrylate/acrylonitrile copolymer (65/35)
P- 27) Diacetonacrylamide/methyl methacrylate copolymer (50/50)
P- 28) Vinyl methyl ketone/isobutyl methacrylate copolymer (55/45)
P- 29) Ethyl methacrylate/n-butyl acrylate copolymer (70/30)
P- 30) Diacetonacrylamide/n-butyl acrylate copolymer (60/40)
P- 31) Methyl methacrylate/cyclohexyl methacrylate copolymer (50/50)
P- 32) n-Butyl acrylate/styrene methacrylate/-diacetonacrylamide copolymer (70/20/10)
P- 33) N-t-Butylmethacrylamide/methyl methacrylate/acrylic acid copolymer (60/30/10)
P- 34) Methyl methacrylate/styrene/vinyl sulfonamide copolymer (70/20/10)
P- 35) Methyl methacrylate/phenyl vinyl ketone copolymer (70/30)
P- 36) n-Butyl acrylate/methyl methacrylate/n-butyl methacrylate copolymer (35/35/30)
P- 37) n-Butyl methacrylate/pentyl methacrylate/N-vinyl-2-pyrrolidone copolymer (38/38/24)
P- 38) Methyl methacrylate/n-butyl methacrylate/isobutyl methacrylate/acrylic acid copolymer (37/29/25/9)
P- 39) n-Butyl methacrylate/acrylic acid copolymer (95/5)
P- 40) Methyl methacrylate/acrylic acid copolymer (95/5)
P- 41) Benzyl methacrylate/acrylic acid copolymer (90/10)
P- 42) n-Butyl methacrylate/methyl methacrylate/benzyl methacrylate/acrylic acid copolymer (35/35/25/5)
P- 43) n-Butyl methacrylate/methyl methacrylate/benzyl methacrylate copolymer (35/35/30)
P- 44) Poly(3-pentyl acrylate)
P- 45) Cyclohexyl methacrylate/methyl methacrylate/n-propyl methacrylate copolymer (37/29/34)
P- 46) Polypentyl methacrylate
P- 47) Methyl methacrylate/n-butyl methacrylate copolymer (65/35)
P- 48) Vinyl acetate/vinyl propionate copolymer (75/25)
P- 49) n-Butyl methacrylate/sodium 3-acryloxybutane-1-sulfonate copolymer (97/3)
P- 50) n-Butyl methacrylate/methyl methacrylate/acrylamide copolymer (35/35/30)
P- 51) n-Butyl methacrylate/methyl methacrylate/vinyl chloride copolymer (37/36/27)
P- 52) n-Butyl methacrylate/styrene copolymer (90/10)
P- 53) Methyl methacrylate/N-vinyl-2-pyrrolidone copolymer (90/10)
P- 54) n-Butyl methacrylate/vinyl chloride copolymer (90/10)
P- 55) n-Butyl methacrylate/styrene copolymer (70/30)
P- 56) Poly(N-sec-butylacrylamide)
P- 57) Poly(N-t-butylacrylamide)
P- 58) Diacetonacrylamide/methyl methacrylate copolymer (62/38)
P- 59) Cyclohexyl methacrylate/methyl methacrylate copolymer (60/40)
P- 60) N-t-Butylacrylamide/methyl methacrylate copolymer (40/60)
P- Poly(N-n-butylacrylamide)
P- 62) t-Butyl methacrylate/N-t-butylacrylamide copolymer (50/50)
P- 63) t-Butyl methacrylate/methyl methacrylate copolymer (70/30)
P- 64) Poly(N-t-butylmethacrylamide)
P- 65) N-t-Butylacrylamide/methyl methacrylate copolymer (60/40)
P- 66) Methyl methacrylate/acrylonitrile copolymer (70/30)
P- 67) Methyl methacrylate/vinyl methyl ketone copolymer (38/62)
P- 68) Methyl methacrylate/styrene copolymer (75/25)
P- 69) Methyl methacrylate/hexyl methacrylate copolymer (70/30)
P- 70) Poly(benzyl acrylate)
P- 71) Poly(4-biphenyl acrylate)
P- 72) Poly(4-butoxycarbonylphenyl acrylate)
P- 73) Poly(sec-butyl acrylate)
P- 74) Poly(t-butyl acrylate)
P- 75) Poly[3-chloro-2,2-bis(chloromethyl)propyl acrylate]
P- 76) Poly(2-chlorophenyl acrylate)
P- 77) Poly(4-chlorophenyl acrylate)
P- 78) Poly(pentachlorophenyl acrylate)
P- 79) Poly(4-cyanobenzyl acrylate)
P- 80) Poly(cyanoethyl acrylate)
P- 81) Poly(4-cyanophenyl acrylate)
P- 82) Poly(4-cyano-3-thiabutyl acrylate)
P- 83) Poly(cyclohexyl acrylate)
P- 84) Poly(2-ethoxycarbonylphenyl acrylate)
P- 85) Poly(3-ethoxycarbonylphenyl acrylate)
P- 86) Poly(4-ethoxycarbonylphenyl acrylate)
P- 87) Poly(2-ethoxyethyl acrylate)
P- 88) Poly(3-ethoxypropyl acrylate)
P- 89) Poly(1H,1H,5H-octafluoropentyl acrylate)
P- 90) Poly(heptyl acrylate)
P- 91) Poly(hexadecyl acrylate)
P- 92) Poly(hexyl acrylate)
P- 93) Poly(isobutyl acrylate)
P- 94) Poly(isopropyl acrylate)
P- 95) Poly(3-methoxybutyl acrylate)
P- 96) Poly(2-methoxycarbonylphenyl acrylate)
P- 97) Poly(3-methoxycarbonylphenyl acrylate)
P- 98) Poly(4-methoxycarbonylphenyl acrylate)
P- 99) Poly(2-methoxyethyl acrylate)
P-100) Poly(4-methoxyphenyl acrylate)
P-101) Poly(3-methoxypropyl acrylate)
P-102) poly(3,5-dimethyladamantyl acrylate)
P-103) Poly(3-dimethylaminophenyl acrylate)
P-104) Polyvinyl t-butyrate
P-105) Poly(2-methylbutyl acrylate)
P-106) Poly(3-methylbutyl acrylate)
P-107) Poly(1,3-dimethylbutyl acrylate)
P-108) Poly(2-methylpentyl acrylate)
P-109) Poly(2-naphthyl acrylate)
P-110) Poly(phenyl acrylate)
P-111) Poly(propyl acrylate)
P-112) Poly(m-tolyl acrylate)
P-113) Poly(o-tolyl acrylate)
P-114) Poly(p-tolyl acrylate)

P-115) Poly(N,N-dibutylacrylamide)
P-116) Poly(isohexylacrylamide)
P-117) Poly(isooctylacrylamide)
P-118) Poly(N-methyl-N-phenylacrylamide)
P-119) Poly(adamantyl methacrylate)
P-120) Poly(benzyl methacrylate)
P-121) Poly(2-bromoethyl methacrylate)
P-122) Poly(2-N-t-butylaminoethyl methacrylate)
P-123) Poly(sec-butyl methacrylate)
P-124) Poly(t-butyl methacrylate)
P-125) Poly(2-chloroethyl methacrylate)
P-126) Poly(2-cyanoethyl methacrylate)
P-127) Poly(2-cyanomethylphenyl methacrylate)
P-128) Poly(4-cyanophenyl methacrylate)
P-129) Poly(cyclohexyl methacrylate)
P-130) Poly(dodecyl methacrylate)
P-131) Poly(diethylaminoethyl methacrylate)
P-132) Poly(2-ethylsulfinylethyl methacrylate)
P-133) Poly(hexadecyl methacrylate)
P-134) Poly(hexyl methacrylate)
P-135) Poly(2-hydroxypropyl methacrylate)
P-136) Poly(4-methoxycarbonylphenyl methacrylate)
P-137) Poly(3,5-dimethyladamantyl methacrylate)
P-138) Poly(dimethylaminoethyl methacrylate)
P-139) Poly(3,3-dimethylbutyl methacrylate)
P-140) Poly(3,3-dimethyl-2-butyl methacrylate)
P-141) Poly(3,5,5-trimethylhexyl methacrylate)
P-142) Poly(octadecyl methacrylate)
P-143) Poly(tetradecyl methacrylate)
P-144) Poly(4-butoxycarbonylphenylmethacrylamide)
P-145) Poly(4-carboxyphenylmethacrylamide)
P-146) Poly(4-ethoxycarbonylphenylmethacrylamide)
P-147) Poly(4-methoxycarbonylphenylmethacrylamide)
P-148) Poly(butylbutoxycarbonyl methacrylate)
P-149) Poly(butyl chloroacrylate)
P-150) Poly(butyl cyanoacrylate)
P-151) Poly(cyclohexyl chloroacrylate)
P-152) Poly(ethyl chloroacrylate)
P-153) Poly(ethylethoxycarbonyl methacrylate)
P-154) Poly(ethyl methacrylate)
P-155) Poly(ethyl fluoromethacrylate)
P-156) Poly(hexylhexyloxycarbonyl methacrylate)
P-157) Poly(isobutyl chloroacrylate)
P-158) Poly(isopropyl chloroacrylate)
P-159) Polycyclohexylacrylamide Substantially water-immiscible organic solvents which can be used for preparing a solution of a hydrophobic photographically useful substance and a polymer include, for example, those described in U.S. Pat. Nos. 3,253,921 and 3,514,627 and, more specifically, those having a water solubility of not more than 25% by weight, such as acetic esters of lower alcohols, e.g., ethyl acetate and butyl acetate, ethyl propionate, methyl ethyl ketone, methyl isobutyl ketone, β-ethoxyethyl acetate, methyl cellosolve acetate, methyl carbitol acetate, methyl carbitol propionate, and cyclohexanone. The term "substantially water-immiscible organic solvents" as used herein means the organic solvents having the solubility of 10 wt % or less in water at 20° C.

If desired, a part of the water-immiscible organic solvent may be replaced with a completely water-miscible organic solvent, e.g., methyl alcohol, ethyl alcohol, acetone, and tetrahydrofuran in order to increase the solubility of the hydrophobic photographically useful substance and the polymer. The proportion of completely water-miscible organic solvent is not specifically limited and appropriately determined depending on necessities.

These organic solvents may be used either individually or in combination of two or more thereof.

The amount added of the organic solvent is preferably from 0.05 to 10 g per gram of the hydrophobic photographically useful substance and preferably from 0.5 to 20 g per gram of the polymer.

The aqueous medium which can be used in the present invention is water preferably containing gelatin as a protective colloid. Hydrophilic colloids other than gelatin are also usable. Usable hydrophilic colloids include proteins, e.g., gelatin derivatives, graft polymers of gelatin and other high polymers, albumin, and casein; cellulose derivatives, e.g., hydroxyethyl cellulose, carboxymethyl cellulose, and cellulose sulfate; sugar derivatives, e.g., sodium alginate and starch derivatives; and a variety of synthetic hydrophilic high polymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole, as well as copolymers comprising monomers constituting these homopolymers.

Gelatin to be used includes lime-processed gelatin, acid-processed gelatin, and enzyme-processed gelatin as described in *Bull. Soc. Sci. Photo. Japan*, No. 16, p. 30 (1966), as well as hydrolysis products and enzymatic decomposition products of gelatin.

The particle size range of the oil droplets in the oil-in-water type dispersion of the present invention is preferably from 0.01 to 1.00 μm, more preferably from 0.01 to 0.50 μm. In the emulsified dispersion according to the present invention, the polymer and the hydrophobic photographically useful substance form the same oil droplets. That is, the polymer serves to improve stability of the hydrophobic photographically useful substance is assumed that the hydrophobic photographically useful substance and the polymer are compatibilized in the same oil droplets.

The present invention is applicable to both black-and-white silver halide photographic materials and color photographic materials, with the latter being preferably used to produce pronounced effects.

Silver halide emulsions which can be used in the present invention include an emulsion of silver chlorides, silver chlorobromide, silver bromide, or a mixture thereof with silver iodide in the above described protective colloid.

Working embodiments of the present invention will hereinafter be explained by chiefly referring to color light-sensitive materials having a reflective support. The embodiments described are applied to other types of light-sensitive materials with appropriate modifications.

The color light-sensitive material which can be used in the present invention usually comprises a support having thereon at least one blue-sensitive silver halide emulsion layer, at least one green-sensitive silver halide emulsion layer, and at least one red-sensitive silver halide emulsion layer. General color papers have these light-sensitive layers on a support in the order listed above but may have a different order. An infrared-sensitive silver halide emulsion layer may be used in substitution for at least one of these emulsion layers. The light-sensitive emulsion layers each contains a silver halide emulsion having sensitivity to the respective wavelength region and a so-called color coupler forming a dye of a color complementary to the light to which it is sensitive, that is, a yellow dye to blue light, a magenta dye to green light, and a cyan dye to red light, to thereby accomplish color reproduction by a subtractive color process. The light-sensitive material may also have a structure in which the light-sensitive layers and the developed hue of the couplers do not have the above described relationship.

Silver halide emulsions which can be used in the present invention preferably include silver chlorobromide or silver chloride emulsions containing substantially no silver iodide. The terminology "substantially no silver iodide" as used herein means that a silver iodide content is not more than 1 mol %, and preferably not more than 0.2 mol %. While the halogen composition of the silver halide emulsion may be either the same or different among individual grains, use of an emulsion having the same halogen composition among grains makes it easy to obtain grains having uniform properties. The halogen composition may be uniformly distributed throughout the individual grains (homogeneous grains), or the individual grains may have a nonuniformly distributed halogen composition to form a laminate structure comprising a core and a single layered or multilayered outer shell or may have a nonlayered portion differing in halogen composition in the inside or on the surface thereof (when such a portion is on the surface, it is fused on the edge, corner or plane of the grain). Either of the latter two types of grains is preferred to the homogeneous grains in order to obtain high sensitivity and also from the standpoint of pressure resistance. In these heterogeneous grains, the boundary between two layers or portions differing in halogen composition may be either clear or ambiguous while forming mixed crystals due to difference in composition. Further, the structure may be so designed as to have a continuously varying halogen composition.

The halogen composition of the silver chlorobromide emulsions may have an arbitrary silver bromide/silver chloride ratio. While this range can be selected from a broad range, a preferred silver chloride ratio is 2% or more.

In light-sensitive materials suited for rapid processing, a silver chlorobromide emulsion having a high silver chloride content (hereinafter referred to as a high silver chloride emulsion) is preferably used. Such a high silver chloride emulsion preferably has a silver chloride content of 90 mol % or more, and more preferably 95 mol % or more.

Silver halide grains in the high silver chloride emulsion preferably have a localized silver bromide layer(s) or portion(s) (hereinafter inclusively referred to as a localized phase) in the inside and/or on the surface of the individual grains. The localized phase preferably has a silver bromide content of at least 10 mol %, and more preferably more than 20 mol %. The localized phase may be present in the inside of the grains or on the surface (e.g., edges, corners, or planes) of the grains. One preferred example of localized phases is an epitaxially grown portion on the corner(s) of grains.

On the other hand, for the purpose of minimizing reduction in sensitivity on pressure application on a light-sensitive material, a high silver chloride emulsion having a silver chloride content of 90 mol % or higher with its halogen composition being distributed in a narrow range throughout the individual grains is also preferably used.

For the purpose of reducing a rate of replenishment for a developing solution, it is also effective to further increase the silver chloride content of the silver halide emulsions. In this case, an emulsion comprising nearly pure silver chloride having a silver chloride content of from 98 to 100 mol % is preferably used.

Silver halide grains in the silver halide emulsions preferably have a mean grain size of from 0.1 to 2 μm (the mean grain size is a number average of a diameter of a circle equivalent to a projected area of a grain).

The emulsion is preferably a monodispersion in which the grain size distribution has a coefficient of variation (a quotient obtained by dividing a standard deviation by a mean grain size) of not more than 20%, and preferably not more than 15%. For the purpose of obtaining a broad latitude, two or more kinds of monodispersed emulsions may be blended and coated in the same layer or may be separately coated in different layers.

Silver halide grains of the photographic emulsions may have a regular crystal form, such as a cubic form, a tetradecahedral form, and an octahedral form; an irregular crystal form, such as a spherical form and a plate form; or a composite crystal form thereof. The grains may be a mixture of various crystal forms. In the present invention, the grains preferably comprise at least 50%, preferably at least 70%, and more preferably at least 90%, of those having a regular crystal form.

In addition, emulsions containing tabular grains having an average aspect ratio (circle-equivalent diameter/thickness ratio) of 5 or more, preferably 8 or more, in a proportion of more than 50% of the total grains as expressed in terms of a projected area can also be used to advantage.

The silver chlorobromide emulsions which can be used in the present invention can be prepared by known methods as described in P. Grafkides, *Chemie et Physique Photographique*, Paul Montel (1967), G. F. Duffin, *Photographic Emulsion Chemistry*, The Focal Press (1966), and V. L. Zelikman, et al., *Making and Coating Photographic Emulsion*, The Focal Press (1964). In some detail, the emulsions can be prepared by any of the acid process, the neutral process, the ammonia process, etc. The reaction between a soluble silver salt and a soluble halogen salt can be carried out by any of a single jet process, a double jet process, a combination thereof, and the like.

A so-called reverse mixing process in which silver halide grains are formed in the presence of excess silver ions may be used. A so-called controlled doublet jet process, a modified process of a double jet process, in which a pAg value of a liquid phase where silver halide grains are formed is maintained constant may also be employed. According to this process, a silver halide emulsion comprising grains having a regular crystal form and a nearly uniform grain size can be prepared.

During silver halide grain formation or the subsequent physical ripening, various polyvalent metal ion impurities may be introduced. Examples of useful compounds therefor include salts of cadmium, zinc, lead, copper, and thallium; and salts or complex salts of the group VIII metals, e.g., iron, ruthenium, rhodium, palladium, osmium, iridium, and platinum. The group VIII metal compounds are particularly preferred. These compounds are preferably used in an amount of from $1\times10^{-9}$ to $1\times10^{=2}$ mol per mol of silver halide, though widely varying depending on the end use of the light-sensitive material.

The silver halide emulsions are usually subjected to chemical sensitization and spectral sensitization.

Chemical sensitization of silver halide emulsions can be performed by sulfur sensitization represented by addition of an unstable sulfur compound, reduction sensitization, noble metal sensitization represented by gold sensitization or any other known techniques, either alone or in combination thereof. Compounds which can be preferably used for chemical sensitization are described in JP-A-62-215272, page 18, right lower column to page 22, right upper column.

Spectral sensitization is conducted for endowing the emulsion of each light-sensitive layer with spectral sensitivity to a desired wavelength region. Spectral sensitization is preferably carried out by adding a dye which absorbs light of the wavelength region corresponding to the desired spectral sensitivity, i.e., a spectral sensitizing dye. Examples of suitable sensitizing dyes include those described, e.g., in F. M. Harmer, *Heterocyclic Compounds—Cyanine Dyes and Related Compounds*, John Wiley & Sons, New York, London (1964). Specific examples of preferable sensitizing dyes and details of spectral sensitization are described in JP-A-62-215272, page 22, right upper column to page 38.

For the purpose of preventing fog during preparation, preservation or photographic processing of light-sensitive materials or stabilizing photographic performance properties of light-sensitive materials, various antifoggants or stabilizers or precursors thereof can be introduced into the photographic emulsions. Specific examples of suitable compounds are described in JP-A-62-215272, pages 39 to 72.

The emulsions which can be used in the present invention may be either of surface latent image type forming a latent image predominantly on the grain surface or of internal latent image type forming a latent image predominantly inside of the grain.

Supports which can be generally used in the light-sensitive material include transparent films commonly employed in photographic light-sensitive materials, e.g., a cellulose nitrate film and a polyethylene terephthalate film, and reflective supports. A reflective support is preferred for accomplishing the object of the present invention.

The terminology "reflective support" as used herein means a support having increased reflecting properties to make a dye image formed in silver halide emulsion layers more distinct. Such a reflective support includes a support having coated thereon a hydrophobic resin having dispersed therein a light reflecting substance, e.g., titanium oxide, zinc oxide, calcium carbonate, and calcium sulfate; and a support made from a hydrophobic resin having dispersed therein the above mentioned light reflecting substance. Specific examples of suitable reflective supports include baryta paper, polyethylene-coated paper, polypropylene type synthetic paper; and a transparent support, e.g., a glass plate, a polyester film (e.g., polyethylene terephthalate, cellulose triacetate, cellulose nitrate), a polyamide film, a polycarbonate film, a polystyrene film, and a vinyl chloride resin film, having thereon a reflective layer or containing therein a reflective substance.

In addition, a support with a metallic surface exhibiting specular reflection or diffused reflection of the second kind can also be used as a reflective support. The metallic surface preferably has a spectral reflectance of 0.5 or more in the visible wavelength region. Diffused reflection is obtained by roughening a metal surface or by using a powdered metal. Suitable metals include aluminum, tin, silver, magnesium or alloys thereof. The surface may be made of metallic plate, metallic foil, or metallic thin film formed by rolling, vacuum deposition, plating, etc. A support comprising a nonmetallic material having formed thereon a metal deposit by vacuum evaporation is particularly preferred. The metallic surface preferably has thereon a water resistant resin layer, and especially a thermoplastic resin layer. On the side of the support opposite to the metallic surface, an antistatic layer is preferably provided. The details for such a support having a metallic surface are described, e.g., in JP-A-61-210346, JP-A-63-24247, JP-A-63-24251, and JP-A-63-24255.

A choice is made among the above described various supports according to the end use.

The light reflecting substance which can be used in the reflective support preferably includes a white pigment sufficiently kneaded in the presence of a surface active agent. The pigment particles are preferably pretreated with a di- to tetrahydric alcohol.

A ratio (%) of an area occupied by white pigment particles per unit area is obtained most typically by dividing an observed area into bordering unit areas each of 6 $\mu m \times 6$ $\mu m$ and determining a ratio of the area (%, Ri) occupied by the fine particles projected on each unit area. A coefficient of variation of the area ratio (%) can be calculated from a ratio of a standard deviation (s) of Ri to an average ($\overline{R}$) of Ri, i.e., $s/\overline{R}$. The number (n) of unit areas subject to determination is preferably 6 or more. Accordingly, a coefficient of variation $s/\overline{R}$ can be obtained from:

$$s/R = \frac{\sqrt{\dfrac{\sum_{i=1}^{n} (Ri - R)^2}{n-1}}}{\dfrac{\sum_{i=1}^{n} Ri}{n}}$$

The fine pigment particles to be used in the present invention preferably have a coefficient of variation ($s/\overline{R}$) of not more than 0.15, and more preferably not more than 0.12. Those particles having the $s/\overline{R}$ of 0.08 or less are regarded as uniformly dispersed.

A color developing solution which can be used for development processing of light-sensitive materials preferably includes an alkaline aqueous solution containing an aromatic primary amine color developing agent as a main component. Useful color developing agents include aminophenol compounds and, preferably, p-phenylenediamine compounds. Typical examples of p-phenylenediamine developing agents are 3-methyl-4-amino-N,N-diethylaniline, 3-methyl-4-amino-N-ethyl-N-$\beta$hydroxyethylaniline, 3-methyl-4-amino-N-ethyl-N-$\beta$-methanesulfonamidoethylaniline, and 3-methyl-4-amino-N-ethyl-N-$\beta$-methoxyethylaniline, and sulfates, hydrochlorides or p-toluenesulfonates thereof. If desired, these compounds may be used in combination of two or more thereof.

A color developing solution usually contains a pH buffer, e.g., alkali metal carbonates or phosphates; and development inhibitors or antifoggants, e.g., bromides, iodides, benzimidazoles, benzothiazoles, and mercapto compounds. If desired, the color developing solution further contains various preservatives, e.g., hydroxylamine, diethylhydroxylamine, sulfites, hydrazines (e.g., N,N-biscarboxymethylhydrazine), phenyl semicarbazides, triethanolamine, and catecholsulfonic acids; organic solvents, e.g., ethylene glycol and diethylene glycol; development accelerators, e.g., benzyl alcohol, polyethylene glycol, quaternary ammonium salts, and amines; dye forming couplers; competing couplers; auxiliary developing agents, e.g., 1-phenyl-3-pyrazolidone; tackifiers; and various chelating agents, e.g., aminopolycarboxylic acids, aminopolyphosphonic acids, alkylphosphonic acids, and phosphonocarboxylic acids. Typical examples of the chelating agents are ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, and ethylenediamine-di(o-hydroxyphenylacetic acid), and salts thereof.

Where reversal development is conducted, color development is generally preceded by black-and-white development. A black-and-white developing solution to be used contains one or more of known black-and-white developing agents, such as dihydroxybenzenes, e.g., hydroquinone; 3-pyrazolidones, e.g., 1-phenyl-3-pyrazolidone; and aminophenols, e.g., N-methylpaminophenol.

The color developing solution and black-and-white developing solution generally have a pH of from 9 to 12. A rate of replenishment for these developing solutions is usually 3 liters or less per $m^2$ of a light-sensitive material, though varying depending on the kind of the light-sensitive material. The replenishment rate may be reduced to 500 $ml/m^2$ or less by reducing the bromide ion concentration in the replenisher. In the case of reducing the replenishment rate, it is preferable to prevent evaporation or aerial oxidation of the processing solution by minimizing the liquid surface area of the processing tank in contact with air. The contact area between the photographic processing solution and air can be expressed in terms of opening ratio calculated by dividing a contact area ($cm^2$) of the processing solution with air by a volume ($cm^3$) of the processing solution. The opening ratio as defined above is preferably not more than 0.1, and more preferably between 0.001 and 0.05.

The opening ratio of the processing tank can be so adjusted by, for example, putting a barrier, such as a floating cover, on the liquid surface, using a movable cover as described in JP-A-62-241342, or utilizing slit development processing as described in JP-A-63-216050.

Reduction of the opening ratio is preferably applied to not only color development/black-and-white development but also all the subsequent steps, such as bleach, bleach-fix, fixing, washing, and stabilization.

Reduction of a replenishment rate may also be achieved by using a means for suppressing accumulation of a bromide ion in the developing solution.

Color development is usually effected for a processing time of from 2 to 5 minutes. The processing time can be shortened by using a high temperature and a high pH and increasing a concentration of a color developing agent.

The photographic emulsion layers after color development is usually subjected to bleach. Bleach and fixing may be carried out either simultaneously (bleach-fix) or separately. For rapid processing, bleach may be followed by bleach-fix. Further, the mode of desilvering can be arbitrarily selected according to the end use. For example, bleach-fix may be effected using two tanks connected, fixing may be followed by bleach-fix, or bleach-fix may be followed by bleach.

Bleaching agents to be used include compounds of polyvalent metals, e.g., iron(III). Typical bleaching agents include organic complex salts of iron(III), e.g., complex salts with aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanoltetraacetic acid, glycol ether diaminetetraacetic acid) or organic acids (e.g., citric acid, tartaric acid, and malic acid). Preferred of them are aminopolycarboxylic acid iron(III) complexes, e.g., (ethylenediaminetetraacetato)iron(III) salts from the standpoint of rapidness of processing and prevention of environmental pollution. Aminopolycarboxylic acid iron(III) complex salts are particularly useful either in a bleaching bath or in a bleach-fix monobath. A bleaching bath or bleach-fix bath containing these aminopolycarboxylic acid iron(III) complex salts usually has a pH between 4.0 and 8.0. A lower pH is also employed for rapid processing.

If desired, a fixing bath, a bleach-fix bath, or a prebath thereof may contain known bleaching accelerators. Useful bleaching accelerators include compounds having a mercapto group or a disulfide group as described in U.S. Pat. No. 3,893,858, German Patent 1,290,812, JP-A-53-95630, *Research Disclosure*, No. 17129 (July, 1978); thiazolidine derivatives as described in JP-A-50-140129; thiourea derivatives as described in U.S. Pat. No. 3,706,561; iodides as described in JP-A-58-16235; polyoxyethylene compounds as described in German Patent 2,748,430; polyamine compounds described in JP-B-45-8836; and bromide ion. Among them, compounds having a mercapto group or a disulfide group are preferred because of their high accelerating effect. The compounds disclosed in U.S. Pat. No. 3,893,858, West German Patent 1,290,812, and JP-A-53-95630 are particularly preferred. In addition, the compounds disclosed in U.S. Pat. No. 4,552,834 are also preferred. These bleaching accelerators may be incorporated into a light-sensitive material. The bleaching accelerators are particularly effective for bleach-fix of color light-sensitive materials for photographing.

Fixing agents which can be used include thiosulfates, thiocyanates, thioether compounds, thioureas, and a large quantity of an iodide, with thiosulfates being commonly employed. In particular, ammonium thiosulfate is widely useful. Preservatives for the bleach-fix bath preferably include sulfites, bisulfites, carbonyl-bisulfite adducts, and sulfinic acid compounds, e.g., p-toluenesulfinic acid.

The silver halide color light-sensitive material after desilvering is generally subjected to washing and/or stabilization.

The amount of washing water to be used in the washing step is selected from a broad range depending on characteristics of the light-sensitive material (e.g., the kind of photographic materials such as couplers), the end use of the light-sensitive material, the temperature of washing water, the number of washing tanks (the number of stages), the replenishing system (e.g., counterflow system or direct flow system), and other various conditions. For example, a relation between the number of washing tanks and the quantity of water in a multistage counterflow system can be obtained by the method described in *Journal of the Society of Motion*

*Picture and Television Engineers*, Vol. 64, pp. 248–253 (May, 1955).

According to the disclosed multistage counterflow system, a requisite amount of water can be greatly reduced. On the other hand, bacteria tend to grow in the tank with an increase in water retention time, and suspended bacterial cells adhere to light-sensitive materials. Such a problem can be effectively coped with by adopting a method of reducing calcium and magnesium ions of washing water as described in JP-A-62-288838. It is also effective to use bactericides, such as isothiazolone compounds or thiabendazole compounds as described in JP-A-57-8542; chlorine type bactericides, e.g., chlorinated sodium isocyanurate; and other bactericides described in Hiroshi Horiguchi, *Bokin Bobaizai no Kagaku*, Sankyo Shuppan (1986), Eisei Gijutsukai (ed.), *Biseibutsu no Mekkin, Sakkin, Bobai Gijutsu*, Kogyo Gijutsukai (1982), and Nippon Bokin Bobai Gakkai (ed.), *Bokin Bobaizai Jiten* (1986), e.g., benzotriazole.

Washing water has a pH usually between 4 and 9, and preferably between 5 and 8. Washing conditions, though varying depending on the characteristics or the end use of the light-sensitive material and the like, are usually from 15° to 45° C. in temperature and from 20 seconds to 10 minutes in time, and preferably from 25° to 40° C. in temperature and from 30 seconds to 5 minutes in time.

The washing step may be followed by or replaced with stabilization processing. Where stabilization is conducted in place of washing, any of known stabilizing techniques described, e.g., in JP-A-57-8543, JP-A-58-4834, and JP-A-60-220345 can be utilized. Where washing is followed by stabilization, a stabilizing bath to be used includes a solution containing formalin and a surface active agent, which is used as a final bath for color light-sensitive materials for photographing. If desired, the stabilizing bath may also contain various chelating agents and antifungals.

An overflow accompanying replenishment for washing and/or stabilization may be reused in other processing steps, such as a desilvering step.

For the purpose of simplifying and speeding up processing, the silver halide color light-sensitive material may contain therein a color developing agent, preferably in the form of a precursor thereof. Examples of color developing agent precursors include indoaniline compounds described in U.S. Pat. No. 3,342,597, Schiff base compounds described in U.S. Pat. No. 3,342,599, *Research Disclosure*, Nos. 14850 and 15159, aldol compounds described in *Research Disclosure*, No. 13924, metal complex salts described in U.S. Pat. No. 3,719,492, and urethane compounds described in JP-A-53-135628.

If desired, the silver halide color light-sensitive material may further contain therein various 1-phenyl-3-pyrazolidone compounds for the purpose of accelerating color development. Typical examples of these accelerators are described in JP-A-56-64339, JP-A-57-144547, and JP-A-58-115438.

Each of the above described processing solutions is used at a temperature of from 10° to 50° C. and, in a standard manner, from 33° to 38° C. Higher processing temperatures may be employed for reducing processing time, or lower temperatures may be employed for improving image quality or stability of the processing solution. Further, as disclosed in West German Pat. No. 2,226,770 or U.S. Pat. No. 3,674,499, cobalt intensification or hydrogen peroxide intensification may be performed for a saving in silver amount to be used in light-sensitive materials.

The present invention is now illustrated in greater detail by way of the following Examples, but it should be understood that the present invention is not deemed to be limited thereto . All the percents and ratios are by weight unless otherwise indicated.

EXAMPLE 1

In 70 cc of an auxiliary solvent S-1 were dissolved 8.2 g of a cyan coupler C-1, 4.1 g of a cyan coupler C-2, 13.5 g of a high boiling solvent O-1, 6.0 g of a dye image stabilizer R-1, and 1.4 g of a dye image stabilizer R-2 at 60° C. The solution was mixed with 100 g of a 16% gelatin aqueous solution containing 10 cc of 5% dodecylbenzenesulfonic acid at 50° C., and the mixture was emulsified in a high speed stirring machine ("Auto Homomixer" manufactured by Tokushukika Kogyo K. K.). Water was added to the emulsion to make 400 g to prepare a comparative dispersion (designated 1-(a)).

A comparative dispersion (1-(b)) was prepared in the same manner as described above, except that the above prepared solution further contained 12.5 g of a hydrophobic polymer
P-57.

Dispersions (1-(c) to (i)) according to the present invention were prepared as follows.

1-1) Preparation of Aqueous Medium and Solutions:

100 g of a 16% gelatin aqueous solution containing 10 cc of 5% dodecylbenzenesulfonic acid was used at 50° C. as an aqueous medium. A solution (A) or (B) to be added was prepared by dissolving a polymer or a hydrophobic photographically useful substance shown in Table 1 below in an auxiliary solvent S-1 at 60° C. The resulting solutions were designated A-1 to A-3 and B-1 to B-9.

TABLE 1

| Solution No. | Photographically Useful Substance (g) | | Polymer (g) | | Auxiliary Solvent S-1 (cc) |
|---|---|---|---|---|---|
| A-1 | | | P-57 | (12.5) | 40.0 |
| A-2 | | | P-159 | (13.0) | 40.0 |
| A-3 | | | P-3 | (11.5) | 40.0 |
| B-1 | C-1 | (8.2) | | | 20.0 |
| | C-2 | (4.1) | | | |
| | R-1 | (6.0) | | | |
| | R-2 | (1.4) | | | |
| B-2 | O-1 | (13.5) | | | 20.0 |
| B-3 | C-3 | (12.0) | | | 20.0 |
| | R-1 | (6.0) | | | |
| | R-2 | (1.4) | | | |
| B-4 | C-4 | (11.8) | | | 20.0 |
| | R-1 | (6.0) | | | |
| | R-2 | (1.4) | | | |
| B-5 | Y-1 | (13.0) | | | 20.0 |
| B-6 | M-15 | (12.3) | | | 20.0 |
| B-7 | O-2 | (14.0) | | | 10.0 |
| B-8 | O-3 | (11.7) | | | 10.0 |
| B-9 | O-4 | (13.0) | | | 10.0 |

The photographically useful substances and polymers in Table 1 above were as follows.

C-1
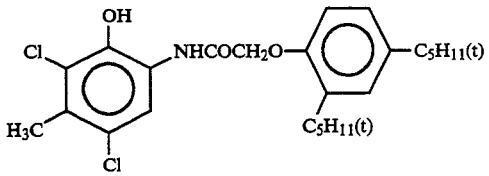
C-2
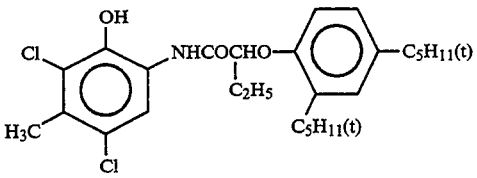
C-3
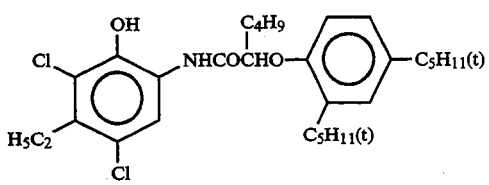
C-4
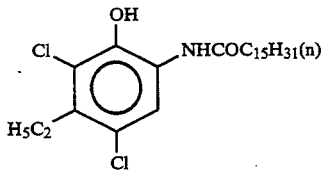
Y-1
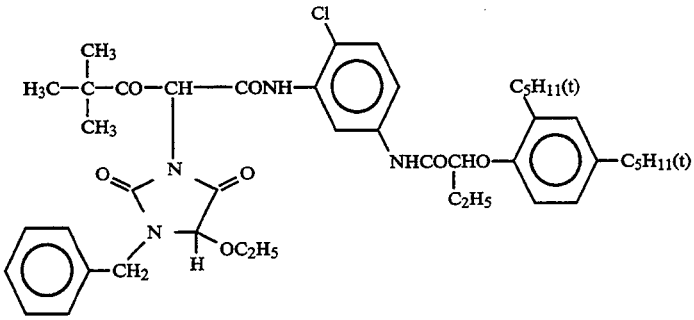
M-15
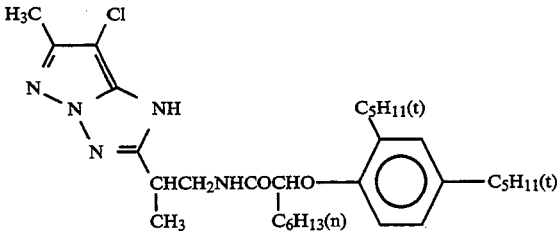
1/0.05 (by weight) mixture of
O-1
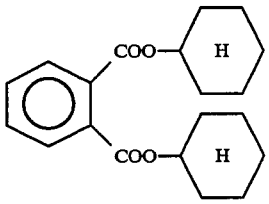
and
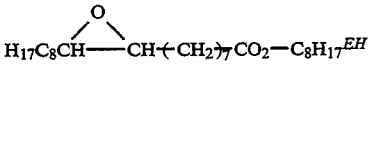
O-2
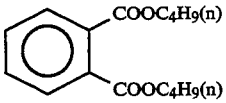
O-3
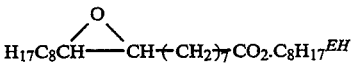
O-4
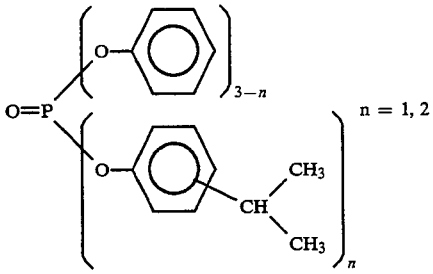
n = 1, 2
2/4/4 (by weight) mixture of
R-1

-continued

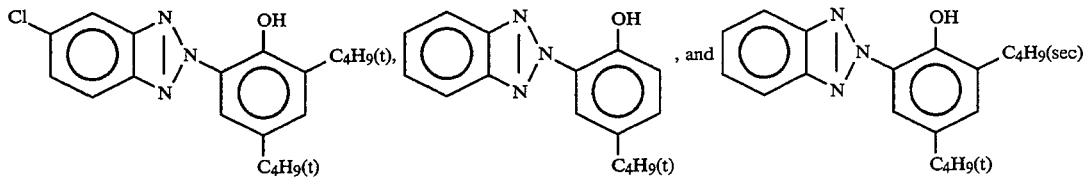

1/1 (by weight) mixture of R-2 $H_3CCOOC_2H_5$ S-1

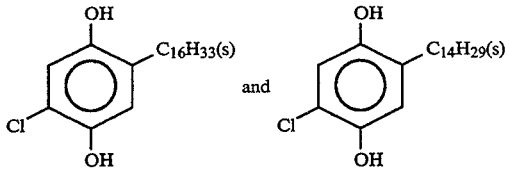

1-2) Preparation of Emulsified Dispersions:

Solutions A-1, B-1, and B-2 were emulsified and dispersed in the above described aqueous medium by means of the above described high speed stirring machine through two or three stages as shown in Table 2 below. After completion of dispersing, water was added thereto to make 400 g.

TABLE 2

| Sample No. | First Stage | Second Stage | Third Stage | Remarks |
|---|---|---|---|---|
| 1-(a) | (B-1, B-2) | — | — | Comparison |
| 1-(b) | (A-1, B-1, B-2) | — | — | " |
| 1-(c) | (A-1) | (B-1, B-2) | — | Invention |
| 1-(d) | (A-1), (B-2) | (B-1) | — | " |
| 1-(e) | (A-1) | (B-1) | (B-2) | " |
| 1-(f) | (A-1, B-1) | (B-2) | — | " |
| 1-(g) | (B-1, a half of B-2) | (A-1), (another half of B-2) | — | " |
| 1-(h) | (B-1, B-2) | (A-1) | — | " |
| 1-(i) | (A-1), (B-1), (B-2) | — | — | " |

In Table 2, the composition of (B-1, B-2) of dispersion 1-(a) is the same as the sum of B-1 and B-2 shown in Table 1, but B-1 and B-2 were dissolved in the same solvent. On the other hand, (A-1), (B-1), (B-2) of dispersion 1-(i) means three separate solutions. Other parentheses in Table 2 and Tables 4 and 6 hereinafter given have the same meaning.

1-3) Evaluation of O/W Dispersion Containing Cyan Coupler:

1-3-1) Stability with Time:

The average particle size of each of the dispersions 1-(a) to (i) was measured. The dispersions were then preserved in a dissolved state at 45° C. for 7 days while stirring under heat, and changes in average particle size were observed. Measurements of average particle size were made using a Nanosizer manufactured by Coulter Co., GB. The results obtained are shown in Table 3 below.

1-3-2) Heat Stability of Cyan Dye Image:

The following layers were provided on a paper support coated on both sides thereof with polyethylene to prepare a multilayer color paper (designated Sample 1-a).

Coating compositions were prepared as follows.

To 19.1 g of a yellow coupler ExY, 4.4 g of a dye image stabilizer Cpd-1, and 0.7 g of a dye image stabilizer Cpd-6 were added 27.2 cc of ethyl acetate and 8.2 g of a solvent Solv-1 to form a solution. The solution was dispersed in 185 cc of a 10% gelatin aqueous solution containing 8 cc of 10% sodium dodecylbenzenesulfonate. Separately, a cubic silver chlorobromide emulsion (a 3/7 (by silver mol ratio) mixture of an emulsion having a mean grain size of 0.88 μm with a coefficient of variation of grain size distribution of 0.08 (hereinafter referred to as a larger size emulsion) and an emulsion having a mean grain size of 0.70 μm with a coefficient of variation of grain size distribution of 0.10 (hereinafter referred to as a smaller size emulsion), both emulsions having a local phase comprising 0.2 mol % of silver bromide on grain surface. To the emulsion were added blue-sensitive sensitizing dyes shown below each in an amount of $2.0\times10^{-4}$ mol per mol of silver for the larger size emulsion and in an amount of $2.5\times10^{-4}$ mol per mol of silver for the smaller size emulsion, and the emulsion was then subjected to sulfur sensitization. The finished emulsion was mixed with each of the above prepared dispersions 1-(a) to 1-(i) to prepare a coating composition for the first layer.

Coating compositions for the second to seventh layers were prepared in the similar manner as described above. Each layer further contained sodium 1-hydroxy-3,5-dichloro-s-triazine as a gelatin hardening agent.

Spectral sensitizing dyes used for light-sensitive emulsion layers were as follows.

Blue-Sensitive Layer:

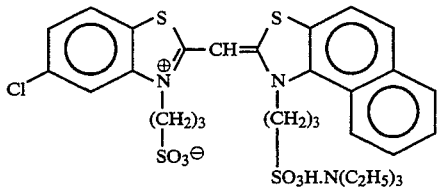

-continued

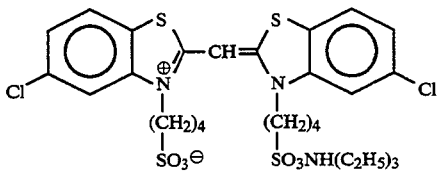

($2.0 \times 10^{-4}$ mol/mol Ag for larger size emulsion; $2.5 \times 10^{-4}$ mol/mol Ag for smaller size emulsion)

Green-Sensitive Layer:

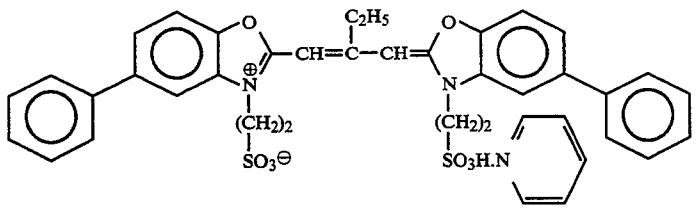

($4.0 \times 10^{-4}$ mol/mol Ag for larger size emulsion; $5.6 \times 10^{-4}$ mol/mol Ag for smaller size emulsion)

and

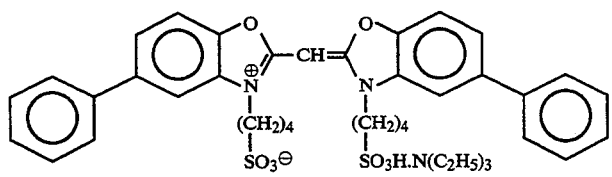

($7.0 \times 10^{-5}$ mol/mol Ag for larger size emulsion; $1.0 \times 10^{-5}$ mol/mol Ag for smaller size emulsion)

Red-Sensitive Layer:

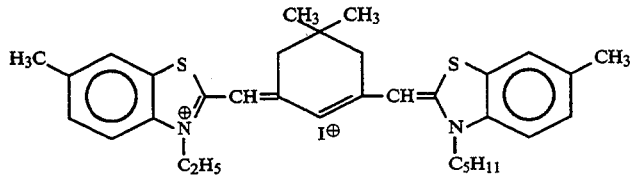

($0.9 \times 10^{-4}$ mol/mol Ag for larger size emulsion; $1.1 \times 10^{-4}$ mol/mol Ag for smaller size emulsion)

To the red-sensitive emulsion layer was further added $2.6 \times 10^{-3}$ mol/mol Ag of a compound having formula:

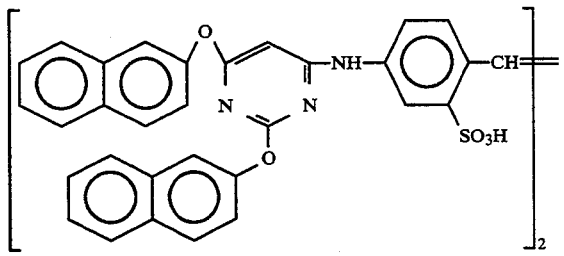

To each of blue-sensitive, green-sensitive, and red-sensitive emulsion layers was added 1-(5-methylureidophenyl)-5-mercaptotetrazole in an amount of $8.5 \times 10^{-5}$ mol, $7.7 \times 10^{-4}$ mol, and $2.5 \times 10^{-4}$ mol, respectively, each per mol of silver halide.

To each of blue-sensitive and green-sensitive emulsion layers was added 4-hydroxy-6-methyl-1,3,3a,7-tetraazaindene in an amount of $1 \times 10^{-4}$ mol and $2 \times 10^{-4}$ mol, respectively, per mol of silver halide.

For the purpose of irradiation prevention, the following dyes were added to each emulsion layer.

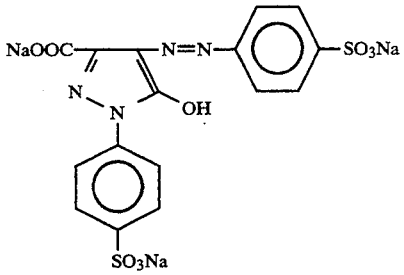

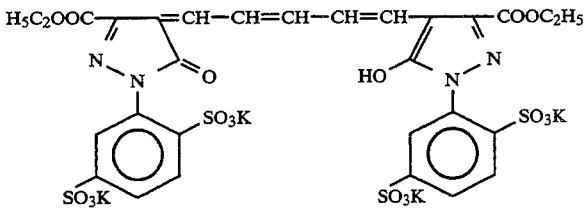

and

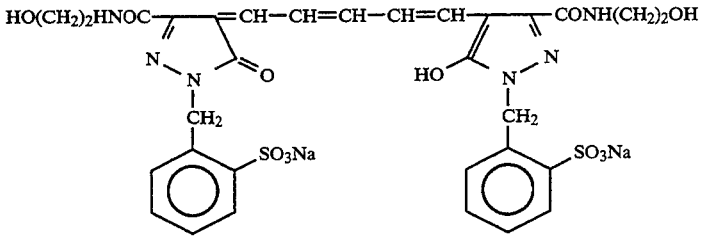

Layer Structure:

Support:

Polyethylene laminated paper, the polyethylene layer on the side of a first layer containing a white pigment ($TiO_2$) and a bluing dye (ultramarine).

| | |
|---|---|
| First Layer (Blue-Sensitive Layer): | |
| The above described silver chlorobromide emulsion | 0.30 g Ag/m$^2$ |
| Gelatin | 1.86 g/m$^2$ |
| Yellow coupler (ExY) | 0.82 g/m$^2$ |
| Dye image stabilizer (Cpd-1) | 0.19 g/m$^2$ |
| Solvent (Solv-1) | 0.35 g/m$^2$ |
| Dye image stabilizer (Cpd-6) | 0.06 g/m$^2$ |
| Second Layer (Color Mixing Preventive Layer): | |
| Gelatin | 0.99 g/m$^2$ |
| Color mixing inhibitor (Cpd-5) | 0.08 g/m$^2$ |
| Solvent (Solv-1) | 0.16 g/m$^2$ |
| Solvent (Solv-4) | 0.08 g/m$^2$ |
| Third Layer (Green-Sensitive Emulsion Layer): | |
| Silver chlorobromide emulsion (cubic; ⅓ (Ag mole ratio) mixture of an emulsion having a mean grain size of 0.55 μm with a coefficient of grain size variation of 0.10 and an emulsion having a mean grain size of 0.39 μm with a coefficent of grain size variation of 0.08, both emulsions having a local phase comprising 0.8 mol % of AgBr on grain surfaces) | 0.12 g Ag/m$^2$ |
| Gelatin | 1.24 g/m$^2$ |
| Magenta coupler (ExM) | 0.20 g/m$^2$ |
| Dye image stabilizer (Cpd-2) | 0.03 g/m$^2$ |
| Dye image stabilizer (Cpd-3) | 0.15 g/m$^2$ |
| Dye image stabilizer (Cpd-4) | 0.02 g/m$^2$ |
| Dye image stabilizer (Cpd-7) | 0.02 g/m$^2$ |

-continued

| | |
|---|---|
| Solvent (Solv-2) | 0.40 g/m$^2$ |
| Fourth Layer (Ultraviolet Absorbing Layer): | |
| Gelatin | 1.58 g/m$^2$ |
| Ultraviolet absorbent (UV-1) | 0.47 g/m$^2$ |
| Color mixing inhibitor (Cpd-5) | 0.05 g/m$^2$ |
| Solvent (Solv-5) | 0.24 g/m$^2$ |
| Fifth Layer (Red-Sensitive Layer): | |
| Silver chlorobromide emulsion (cubic; ¼ (Ag mol ratio) mixture of an emulsion having a mean grain size of 0.58 μm with a coefficient of size variation of 0.09 and an emulsion having a mean grain size of 0.45 μm with a coefficient of size variation of 0.11, both containing a local phase comprising 0.6 mol % of AgBr on grain surfaces) | 0.23 g Ag/m$^2$ |
| Gelatin | 1.34 g/m$^2$ |
| Cyan coupler (C-1 and G-2) | 0.32 g/m$^2$ |
| Dye image stabilizer (R-1) | 0.17 g/m$^2$ |
| Dye image stabilizer (R-2) | 0.04 g/m$^2$ |
| Solvent (O-1) | 0.15 g/m$^2$ |
| Sixth Layer (Ultraviolet Absorbing Layer): | |
| Gelatin | 0.53 g/m$^2$ |
| Ultraviolet absorbent (UV-1) | 0.16 g/m$^2$ |
| Color mixing inhibitor (Cpd-5) | 0.02 g/m$^2$ |
| Solvent (Solv-5) | 0.08 g/m$^2$ |
| Seventh Layer (Protective Layer): | |
| Gelatin | 1.33 g/m$^2$ |
| Polyvinyl alcohol acryl-modified copolymer (degree of modification: 17%) | 0.17 g/m$^2$ |
| Liquid paraffin | 0.03 g/m$^2$ |

Couplers and additives used in the sample preparation were as follows.

(ExY) Yellow Coupler:

-continued
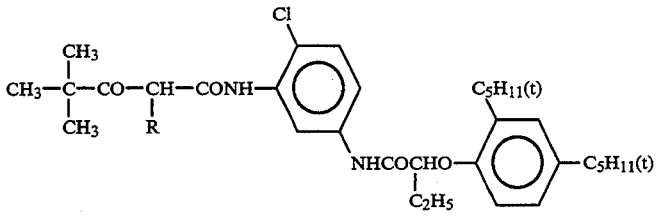
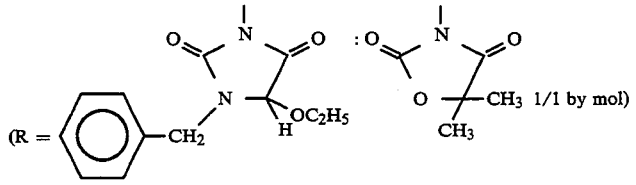
(ExM) Magenta Coupler:
A 1/1 (by mole) mixture of
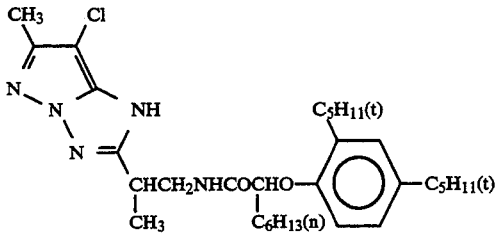
and
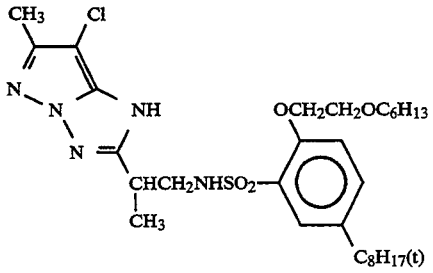
(Cpd-1) Dye Image Stabilizer:
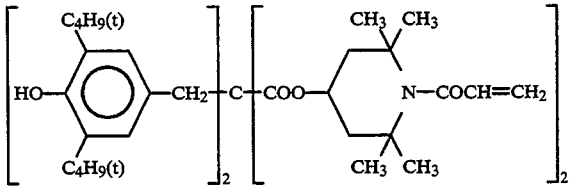
(Cpd-2) Dye Image Stabilizer:
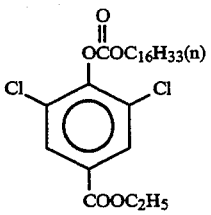
(Cpd-3) Dye Image Stabilizer:
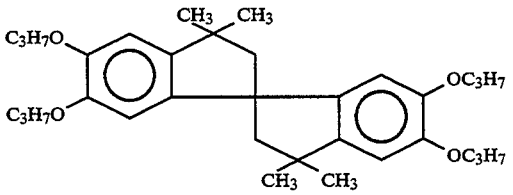
(Cpd-4) Dye Image Stabilizer:
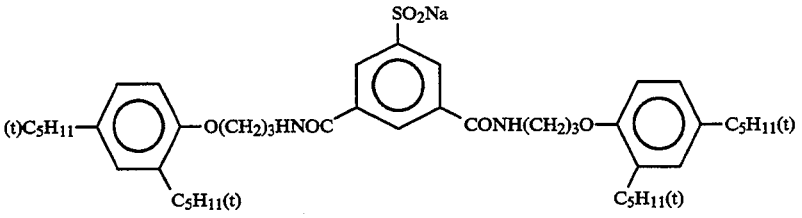
(Cpd-5) Color Mixing Inhibitor:
(Cpd-6) Dye Image Stabilizer:

-continued

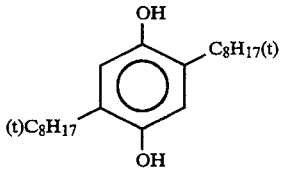

(Cpd-7) Dye Image Stabilizer:

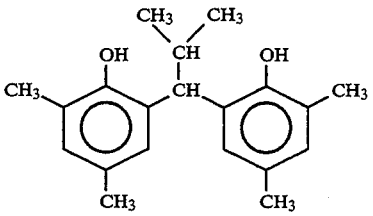

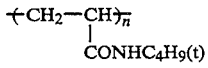

(UV-1) Ultraviolet Absorbent:

A 4/2/4 (by weight) mixture of

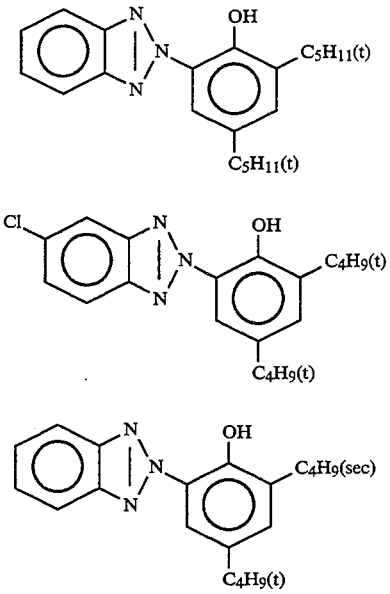

(Solv-1) Solvent:

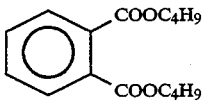

(Solv-2) Solvent:

A 2/1 (by volume) mixture of

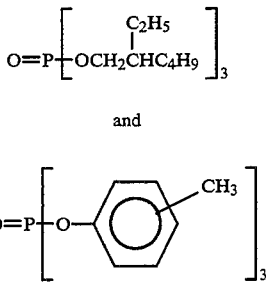

and (Solv-4) Solvent:

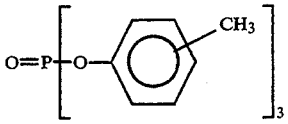

(Solv-5) Solvent:

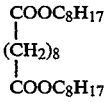

Samples 1-b to 1-i were prepared in the same manner as for Sample 1-a, except replacing dispersion 1-(a) used in the fifth layer of Sample 1-a with each of dispersions 1-(b) to 1-(i).

Each sample was wedgewise exposed to light through a red filter for sensitometry by using a sensitometer ("Model FWH" manufactured by Fuji Photo Film Co., Ltd.; color temperature of a light source: 3,200° K). The exposure was conducted so as to give an exposure amount of 250 CMS for an exposure time of 0.1 second.

The exposed sample was continuously processed by using a paper processor according to the following schedule until the amount of a replenisher supplied to the color developing tank reached twice the tank volume (running test).

| Processing Step | Temperature (°C.) | Time (sec) | Rate of Replenishment (ml/m$^2$) | Capacity of Tank ( ) |
|---|---|---|---|---|
| Color Development | 35 | 45 | 161 | 17 |
| Bleach-Fix | 30–36 | 45 | 215 | 17 |

-continued

| Processing Step | Temperature (°C.) | Time (sec) | Rate of Replenishment (ml/m²) | Capacity of Tank ( ) |
|---|---|---|---|---|
| Stabilization (1) | 30–37 | 20 | — | 10 |
| Stabilization (2) | 30–37 | 20 | — | 10 |
| Stabilization (3) | 30–37 | 20 | — | 10 |
| Stabilization (4) | 30–37 | 30 | 248 | 10 |
| Drying | 70–85 | 60 | | |

Stabilization was carried out in a counterflow system of from tank ( 4 ) towards tank (1) . Each processing solution used had the following formulation:

| Color Developing Solution: | Tank Solution | Replenisher |
|---|---|---|
| Water | 800 ml | 800 ml |
| Ethylenediaminetetraacetic acid | 2.0 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |
| N-Ethyl-N-(β-methanesulfonamidoethyl)-3-methylaniline sulfate | 5.0 g | 7.0 g |
| Diethylhydroxylamine | 4.2 g | 6.0 g |
| Fluorescent brightening agent (4,4'-diaminostilbene type) | 2.0 g | 2.5 g |
| Water to make | 1,000 ml | 1,000 ml |
| pH (25° C.) | 10.05 | 10.45 |

| Bleach-Fix Bath: (tank solution and replenisher had the same formulation) | |
|---|---|
| Water | 400 ml |
| Ammonium thiosulfate (70%) | 100 ml |
| Sodium sulfite | 17 g |
| Ammonium (ethylenediaminetetraacetato)-iron(III) | 55 g |
| Disodium ethylenediaminetetraacetate | 5 g |
| Glacial acetic acid | 9 g |
| Water to make | 1,000 ml |
| pH (25° C.) | 5.40 |

| Stabilizer: (tank solution and replenisher had the same formulation) | |
|---|---|
| Formalin (37%) | 0.1 g |
| Formalin-sulfite adduct | 0.7 g |
| 5-Chloro-2-methyl-4-isothiazolin-3-one | 0.02 g |
| 2-Methyl-4-isothiazolin-3-one | 0.01 g |
| Copper sulfate | 0.005 g |
| Water to make | 1,000 ml |
| pH (25° C.) | 4.0 |

The thus processed samples were allowed to stand in a thermostat at 100° C. for 5 days to examine heat stability of the cyan image. The degree of color change was expressed by a density retention (%) at the area having an initial density of 1.5. The results obtained are shown in Table 3.

TABLE 3

| Sample No. | Mean Particle Size of O/W Dispersion Containing Cyan Coupler: Immediately after Preparation (μm) | After 7 Days (μm) | Cyan Density Retention (100° C. × 5 days) (%) | Remarks |
|---|---|---|---|---|
| 1-a | 0.12 | 0.58 | 41 | Comparison |
| 1-b | 0.16 | 0.37 | 75 | Comparison |
| 1-c | 0.14 | 0.20 | 89 | Invention |
| 1-d | 0.15 | 0.25 | 86 | " |
| 1-e | 0.14 | 0.22 | 88 | " |
| 1-f | 0.14 | 0.19 | 89 | " |
| 1-g | 0.17 | 0.28 | 82 | " |
| 1-h | 0.16 | 0.27 | 82 | " |
| 1-i | 0.16 | 0.24 | 85 | " |

As is apparent from the results in Table 3, the specific method for preparing O/W dispersions according to the present invention produces lipophilic oil droplets having a proper mean particle size, and the resulting dispersions exhibit improved stability with time. Further, light-sensitive materials prepared by using such a dispersion exhibit markedly improved heat stability of a cyan dye image.

EXAMPLE 2

Dispersions 2-(a) to (v) were prepared as shown in Table 4 below in accordance with the same procedure as described in Example 1. Stability of the resulting dispersions with time was evaluated in the same manner as described in (1-3-1) of Example 1. The results obtained are shown in Table 4.

TABLE 4

| Sample No. | First Stage | Second Stage | Third Stage | Mean Particle Size of Dispersion: Immediately after Preparation (μm) | After 7 Days (μm) | Remarks |
|---|---|---|---|---|---|---|
| 2-(a) | (B-1, B-2) | — | — | 0.12 | 0.58 | Comparison |
| 2-(b) | (A-1, B-1, B-2) | — | — | 0.16 | 0.37 | " |
| 2-(c) | (A-2, B-1, B-7) | — | — | 0.17 | 0.39 | " |
| 2-(d) | (A-2, B-3, B-8) | — | — | 0.17 | 0.40 | " |
| 2-(e) | (A-2, B-2, B-6) | — | — | 0.16 | 0.36 | " |
| 2-(f) | (A-3, B-1, B-2) | — | — | 0.17 | 0.37 | " |
| 2-(g) | (A-3, B-5, B-7) | — | — | 0.17 | 0.39 | " |
| 2-(h) | (A-3, B-4, B-8) | — | — | 0.16 | 0.35 | " |
| 2-(i) | (A-2) | (B-3, B-8) | — | 0.14 | 0.21 | Invention |
| 2-(j) | (A-2) | (B-4, B-7) | — | 0.15 | 0.23 | " |
| 2-(k) | (A-2) | (B-2, B-5) | — | 0.14 | 0.22 | " |
| 2-(l) | (A-3) | (B-1, B-7) | — | 0.13 | 0.19 | " |
| 2-(m) | (A-3) | (B-6, B-9) | — | 0.13 | 0.20 | " |

As is apparently seen from the results in Table 4, the method for emulsifying and dispersing according to the present invention proved applicable to a variety of polymers and photographically useful substances and capable of producing dispersions having markedly improved stability with time.

EXAMPLE 3

In 20 cc of an auxiliary solvent S-1 were dissolved 10 g of an ultraviolet absorbent UVA-1 and 5 g of a high boiling organic solvent 0-1 at 60° C. The solution was mixed with 100 g of a 15% gelatin aqueous solution containing 10 cc of 8% dodecylbenzenesulfonic acid at 50° C., and the mixture was emulsified and dispersed in a high speed mixing machine ("Auto Homomixer" manufactured by Tokushukika Kogyo K. K.) to prepare a comparative dispersion 3-(a).

Comparative dispersions 3-(b) and 3-(c) were prepared in the same manner as for 3-(a), except that the solution further contained therein 4.5 g of a hydrophobic polymer P-56 or 5.5 g of a hydrophobic polymer P-124, respectively.

Dispersions 3-(d) to (l) were prepared by once preparing solutions A-31, A-32, and B-31 to 34 as shown in Table 5 below and dispersing the resulting solutions in 100 g of a 15% gelatin aqueous solution at 50° C. according to the order shown in Table 6 below by means of the Auto Homomixer.

TABLE 5

| Solution No. | Polymer or Photographically Useful Substance Kind | Amount (g) | Auxiliary Solvent S-1 (cc) |
|---|---|---|---|
| A-31 | P-56 | 4.5 | 10.0 |
| A-32 | P-124 | 5.5 | 10.0 |
| B-31 | UVA-1 | 10.0 | 6.0 |
| B-32 | UVA-2 | 9.5 | 6.0 |
| B-33 | O-1 | 4.5 | 4.0 |
| B-34 | O-2 | 4.0 | 4.0 |

UVA-1:
A 4/4/2 (by weight) mixture of

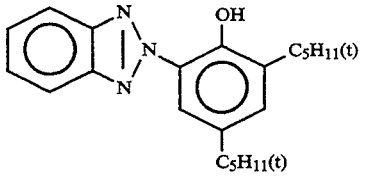

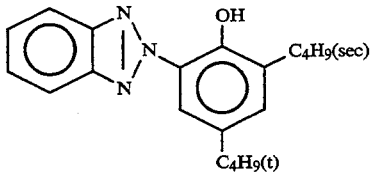

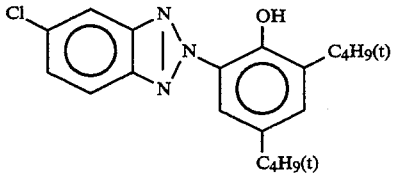

UVA-2:
A 2/4/4 (by weight) mixture of

TABLE 5-continued

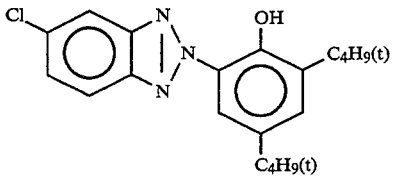

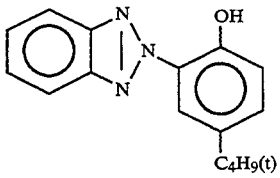

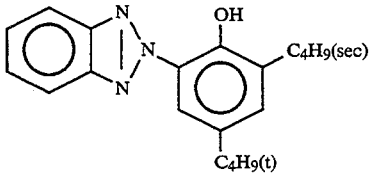

O-1:

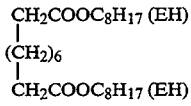

O-2:

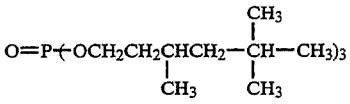

S-1:
$H_3CCOOC_2H_5$ 3-1) Evaluation of O/W Dispersion:

3-1-1) Stability with Time:

Stability of the dispersions 3-(a) to 3-(l) with time was evaluated in the same manner as in Example 1-3-1. The results obtained are shown in Table 6.

3-1-2) Light Stability of Ultraviolet Absorbent:

Water and a gelatin aqueous solution were added to each of the dispersions 3-(a) to 3-(l) to prepare a coating composition. The composition was coated on a transparent support to form an ultraviolet absorbing layer, and a protective layer was further provided thereon to obtain a coated sample having the following layer structure.

| | |
|---|---|
| Second Layer (Protective Layer): | |
| Gelatin | 1.50 g/m$^2$ |
| First Layer (UV Absorbing Layer): | |
| Ultraviolet absorbent | 0.20 g/m$^2$ |
| Gelatin | 1.50 g/m$^2$ |
| Support: | |
| Triacetate cellulose transparent film | |

Each of the coated samples (3-a to 3-l) was subjected to ultraviolet absorption spectrophotometry, and the intensity of the absorption peak was read out. When there were two peaks, the peak at the longer wavelength was read. Then, the sample was exposed to light at 140,000 lux for 21 days in a xenon fadeometer, and ultraviolet spectral absorption was again determined to read the absorption intensity at the same wavelength of the absorption peak shown before exposure.

A ratio of the intensity after exposure to that before exposure was calculated to obtain a percent retention (%).

$$\text{Retention (\%)} = \frac{\text{Intensity after Exposure}}{\text{Intensity before Exposure}} \times 100$$

The results obtained are shown in Table 6.

TABLE 6

| Sample No. | First Stage | Second Stage | Third Stage | Average Particle Size of Dispersion After Preparation (μm) | Average Particle Size of Dispersion After 7 Days (μm) | Retention (%) | Remarks |
|---|---|---|---|---|---|---|---|
| 3-(a) | (B-31, B-33) | — | — | 0.11 | 0.48 | 41 | Comparison |
| 3-(b) | (A-31, B-31, B-33) | — | — | 0.16 | 0.40 | 65 | " |
| 3-(c) | (A-32, B-31, B-34) | — | — | 0.15 | 0.37 | 67 | " |
| 3-(d) | (A-31) | (B-31, B-33) | — | 0.12 | 0.21 | 75 | Invention |
| 3-(e) | (A-32) | (B-31, B-34) | — | 0.13 | 0.20 | 73 | " |
| 3-(f) | (A-31) (B-32) | (B-33) | — | 0.13 | 0.25 | 72 | " |
| 3-(g) | (A-32) (B-32) | (B-33) | — | 0.13 | 0.23 | 71 | " |
| 3-(h) | (A-31) | (B-32) | (B-34) | 0.14 | 0.22 | 76 | " |
| 3-(i) | (A-32) | (B-31) | (B-33) | 0.14 | 0.24 | 72 | " |
| 3-(j) | (A-31) | (B-31) | — | 0.12 | 0.17 | 88 | " |
| 3-(k) | (A-31, B-31) | (B-34) | — | 0.12 | 0.21 | 74 | " |
| 3-(l) | (A-32, B-32) | (B-33) | — | 0.13 | 0.20 | 72 | " |

As is apparent from Table 6, the method for preparing O/W dispersions according to the present invention produce dispersions having markedly improved stability. In the resulting dispersion, the ultraviolet absorbent per se exhibited considerably improved stability to light.

As described above, the present invention makes it possible to improve stability of dispersions of photographically useful substances with time and also to improve stability of the photographically useful substances per se or compounds derived therefrom against heat or light.

While the invention has been described in detail and with reference to specific embodiments thereof, it will be apparent to one skilled in the art that various changes and modifications can be made therein without departing from the spirit and scope thereof.

What is claimed is:

1. A silver halide photographic material containing an oil-in-water type dispersion which is prepared by emulsifying and dispersing a solution (A) of at least one water-insoluble and organic solvent-soluble polymer in a substantially water-immiscible organic solvent and a solution (B) of at least one hydrophobic photographically useful substance in a substantially water-immiscible organic solvent in an aqueous medium (C) either simultaneously or separately, wherein said water-insoluble and organic solvent-soluble polymer comprises a repeating unit having a >C=O bond in the main chain or side chain thereof.

2. A silver halide photographic material as claimed in claim 1, wherein said oil-in-water type dispersion is a dispersion prepared by first dispersing said solution (A) in the aqueous medium and then dispersing said solution (B) in the resulting dispersion.

3. A silver halide photographic material as claimed in claim 2, wherein said polymer comprises, in a side chain thereof, at least one repeating unit containing a

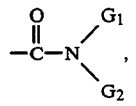

wherein $G_1$ and $G_2$ each represents hydrogen, a substituted or unsubstituted alkyl group or an aryl group.

4. A silver halide photographic material as claimed in claim 1, wherein said oil-in-water type dispersion is obtained by mixing solution (B) and an aqueous medium, followed by emulsifying and dispersing to obtain a first dispersion, and then emulsifying and dispersing solution (A) in said first dispersion.

5. A silver halide photographic material as claimed in claim 1, wherein said water-insoluble and organic solvent-soluble polymer is selected from the group consisting of vinyl polymers, polyester resins obtained by condensation of polyhydric alcohol and polybasic acid, polyesters obtained by ring-opening polymerization, and combination of two or more of said polymers.

6. A silver halide photographic material as claimed in claim 1, wherein said water-insoluble and organic solvent-soluble polymer is used in a weight ratio of from 1/20 to 20/1 by weight based on the weight of the hydrophobic photographically useful compound.

7. A silver halide photographic material as claimed in claim 1, wherein said water-insoluble and organic solvent-soluble polymer is used in a weight ratio of from 1/10 to 10/1 by weight based on the weight of the hydrophobic photographically useful compound.

8. A silver halide photographic material as claimed in claim 1, wherein said solution (B) comprises, as the hydrophobic photographically useful substance, a coupler.

9. A silver halide photographic material as claimed in claim 1, wherein said solution (B) comprises, as the hydrophobic photographically useful substance, a combination of a high boiling organic solvent and a coupler.

10. A silver halide photographic material as claimed in claim 1, wherein said solution (A) further comprises at least one hydrophobic photographically useful substance.

* * * * *